US010624158B2

(12) United States Patent
Schmitt et al.

(10) Patent No.: US 10,624,158 B2
(45) Date of Patent: Apr. 14, 2020

(54) RADIO FREQUENCY HEATING APPARATUS USING DIRECT-DIGITAL RADIO FREQUENCY POWER CONTROL AND FINE-TUNE POWER CONTROL

(71) Applicant: Ultraflex International, Inc., Ronkonkoma, NY (US)

(72) Inventors: Philip Charles Schmitt, Lake Grove, NY (US); Mario Metodiev, West Islip, NY (US); Stanimir Bonev Bonev, Dimitrovgrad (BG)

(73) Assignee: UltraFlex International Inc., Ronkonkoma, NY (US)

( * ) Notice: Subject to any disclaimer, the term of this patent is extended or adjusted under 35 U.S.C. 154(b) by 1048 days.

(21) Appl. No.: 14/873,920

(22) Filed: Oct. 2, 2015

(65) Prior Publication Data

US 2016/0113068 A1 Apr. 21, 2016

Related U.S. Application Data

(60) Provisional application No. 62/066,465, filed on Oct. 21, 2014.

(51) Int. Cl.
*H05B 6/06* (2006.01)

(52) U.S. Cl.
CPC ..... *H05B 6/06* (2013.01)

(58) Field of Classification Search
CPC . H05B 6/04; H05B 6/06; H05B 6/067; H05B 6/10; H05B 6/30; H05H 2001/4652; H05H 1/46

(Continued)

(56) References Cited

U.S. PATENT DOCUMENTS 1,981,631 A 11/1934 Northrup
2,813,186 A 11/1957 Bock
(Continued)

FOREIGN PATENT DOCUMENTS

CN 102427627 B 12/2013
EP 1363474 A2 * 11/2003 ..... C21D 1/10
WO 2009005656 A2 1/2009

OTHER PUBLICATIONS

International Search Report, PCT/US2015/56669, dated Jan. 5, 2016.

(Continued)

*Primary Examiner* — Dana Ross
*Assistant Examiner* — James F Sims, III
(74) *Attorney, Agent, or Firm* — Hoffman & Baron, LLP

(57) ABSTRACT

A radio frequency inductive heating apparatus includes a control device, a plurality of radio frequency devices, a plurality of transformers, a resonant tank circuit, a heating element, a first power supply, and a second power supply. The radio frequency devices are selectively activated by the control device, and each of the plurality of radio frequency devices is coupled to the primary winding of one of the plurality of transformers. The secondary winding of each of the plurality of transformers is coupled to the resonant tank circuit, and the heating element is coupled to the resonant tank circuit. The plurality of radio frequency devices includes a first radio frequency device and a second radio frequency device. The first radio frequency device is coupled to the first power supply, and the second radio frequency device is operatively coupled to the second power supply. A corresponding method is also disclosed.

24 Claims, 15 Drawing Sheets

(58) Field of Classification Search
USPC ..... 219/660, 661–666, 670–672
See application file for complete search history.

(56) References Cited

U.S. PATENT DOCUMENTS

| | | | | |
|---|---|---|---|---|
| 3,398,252 | A | 8/1968 | Bock et al. | |
| 3,566,243 | A | 2/1971 | Landis | |
| 3,816,690 | A | 6/1974 | Mittelmann | |
| 4,471,196 | A | 9/1984 | Frank et al. | |
| 4,580,111 | A | 4/1986 | Swanson | |
| 5,048,032 | A | 9/1991 | Ekstrand et al. | |
| 5,214,258 | A | 5/1993 | Akers | |
| 5,640,111 | A | 6/1997 | Hasegawa | |
| 5,773,799 | A | 6/1998 | Maxfield et al. | |
| 6,147,553 | A | 11/2000 | Kolanek | |
| 6,246,040 | B1 | 6/2001 | Gunn | |
| 6,294,957 | B1 | 9/2001 | Luu | |
| 6,411,655 | B1 * | 6/2002 | Holden | H04L 27/361 332/103 |
| 6,521,874 | B2 | 2/2003 | Thompson et al. | |
| 6,618,276 | B2 | 9/2003 | Bennett | |
| 6,703,080 | B2 | 3/2004 | Reyzelman et al. | |
| 7,369,819 | B2 | 5/2008 | Luu | |
| 7,459,899 | B2 | 12/2008 | Mattaboni et al. | |
| 8,140,035 | B2 | 3/2012 | Hardy et al. | |
| 8,468,871 | B2 | 6/2013 | Potyrailo et al. | |
| 8,482,205 | B2 | 7/2013 | Kirchmeier et al. | |
| 8,542,471 | B2 | 9/2013 | Bulliard et al. | |
| 8,587,238 | B2 | 11/2013 | Maiocchi | |
| 8,686,792 | B2 | 4/2014 | Sukegawa et al. | |
| 8,780,585 | B2 * | 7/2014 | Ye | H02M 3/285 363/17 |
| 2008/0298104 | A1 * | 12/2008 | Sachdeva | H02M 7/49 363/98 |
| 2010/0045202 | A1 | 2/2010 | That et al. | |
| 2010/0052568 | A1 | 3/2010 | Cohen | |
| 2012/0256702 | A1 | 10/2012 | Khlat et al. | |
| 2013/0278069 | A1 | 10/2013 | Amei et al. | |
| 2014/0319128 | A1 | 10/2014 | Paull | |

OTHER PUBLICATIONS

Serrano et al., "The LHC AC Dipole System: an Introduction", European Organization for Nuclear Research CERN—Beams Department, pp. 1-29, May 2010.

Prof. B. Jayant Baliga, "The Insulated Gate Bipolar Transistor", The IGBT Compendium: Applications and Social Impact, pp. 1-141, Jun. 20, 2011.

* cited by examiner

RADIO FREQUENCY HEATING APPARATUS USING DIRECT-DIGITAL RADIO FREQUENCY POWER CONTROL AND FINE-TUNE POWER CONTROL

CROSS-REFERENCE TO RELATED APPLICATION

This application claims the benefit of U.S. Provisional Application No. 62/066,465, filed Oct. 21, 2014, the disclosure of which is incorporated by reference herein in its entirety.

BACKGROUND

Field

The disclosed embodiments relate to radio frequency (RF) industrial power systems. More particularly, the disclosed embodiments relate to RF heating power systems, which are used in RF induction heating and melting applications, as well as plasma generation, corona discharge, and RF heating of hydrocarbons.

SUMMARY

The embodiments disclosed herein include a method to directly control radio frequency (RF) power of an induction heating or industrial RF power system, which enables control over output power by utilizing direct-digital RF power control combined with one or more techniques of fine-tune power control. Combining direct-digital RF power control with fine-tune power control allows full control of the RF power without requiring an intermediate full-power control stage in the system, such as a silicon-controlled rectifier (SCR) controller or DC-to-DC conversion stages, reduces the quantity of RF devices used in the system, and eliminates efficiency issues found in methods of directly controlling RF power.

A radio frequency inductive heating apparatus in accordance with the embodiments disclosed herein includes a control device, a plurality of radio frequency devices, a plurality of transformers, a resonant tank circuit, a heating element, a first power supply, and a second power supply. Each of the plurality of radio frequency devices is selectively activated by the control device. Each of the plurality of transformers includes a primary winding and a secondary winding, and each of the plurality of radio frequency devices is operatively coupled to the primary winding of one of the plurality of transformers. The secondary winding of each of the plurality of transformers is operatively coupled to the resonant tank circuit, and the heating element is operatively coupled to the resonant tank circuit. The plurality of radio frequency devices includes a first radio frequency device and a second radio frequency device. The first radio frequency device is operatively coupled to the first power supply, and the second radio frequency device is operatively coupled to the second power supply.

The plurality of radio frequency devices may receive a radio frequency signal from the control device. The radio frequency signal may provide an operating frequency associated with the plurality of radio frequency devices, and the operating frequency may be based on a resonant frequency of the resonant tank circuit. The second power supply may be a variable power supply, and an output voltage associated with the first power supply may be greater than an output voltage associated with the second power supply.

The at least one of the plurality of radio frequency devices may be selectively activated by the control device based on a power set signal and a feedback signal. The power set signal may represent a desired voltage associated with the resonant tank circuit, and the feedback signal may represent an electrical parameter associated with the resonant tank circuit.

At least one of the plurality of radio frequency devices may include a full bridge inverter that receives a first phase signal and a second phase signal. A phase difference between the first phase signal and the second phase signal may be selectively adjusted to modify an output voltage associated with the at least one of the plurality of radio frequency devices.

The plurality of transformers may include a first transformer and a second transformer. The first transformer may include a first turns ratio, the second transformer may include a second turns ratio, and the first turns ratio may be different from the second turns ratio. The plurality of radio frequency devices may include a first radio frequency device and a plurality of second radio frequency devices. The plurality of transformers may include a first transformer and a plurality of second transformers. The first radio frequency device may be operatively coupled to the primary winding of the first transformer, and each of the plurality of second radio frequency devices may be operatively coupled to the primary winding of one of the plurality of second transformers. The plurality of second transformers may include a turns ratio equal to one of n:1 and (n−1):1, where n represents a quantity of second radio frequency devices. Each of the plurality of second transformers may include a turns ratio equal to $2^n$:1, where n represents an increasing positive integer.

The radio frequency inductive heating apparatus may include a first power supply and a second power supply, and the plurality of second radio frequency devices may include a first radio frequency device and a second radio frequency device. The first radio frequency device may be operatively coupled to the first power supply, and the second radio frequency device may be operatively coupled to the second power supply. The second power supply may be a variable power supply, and an output voltage associated with the first power supply may be greater than an output voltage associated with the second power supply. An output voltage associated with the second power supply may be twice an output voltage associated with the first power supply. At least one of the first power supply and the second power supply may include a rectifier.

A method of providing radio frequency inductive heating in accordance with the embodiments disclosed herein include activating a plurality of radio frequency devices selectively by a control device, coupling each of the plurality of radio frequency devices operatively to a primary winding of one of a plurality of transformers, coupling a secondary winding of each of the plurality of transformers operatively to a resonant tank circuit, coupling a heating element operatively to the resonant tank circuit, coupling a first radio frequency device operatively to a first power supply, and coupling a second radio frequency device operatively to a second power supply.

The method may include receiving a radio frequency signal from the control device by the plurality of radio frequency devices. The radio frequency signal may provide an operating frequency associated with the plurality of radio frequency devices, and the operating frequency may be based on a resonant frequency of the resonant tank circuit. The second power supply may be a variable power supply, and an output voltage associated with the first power supply may be greater than an output voltage associated with the second power supply.

The method may include activating the at least one of the plurality of radio frequency devices selectively by the control device based on a power set signal and a feedback signal. The power set signal may represent a desired voltage associated with the resonant tank circuit, and the feedback signal may represent an electrical parameter associated with the resonant tank circuit. At least one of the plurality of radio frequency devices may include a full bridge inverter, and the method may include receiving, by the full bridge inverter, a first phase signal and a second phase signal, and modifying a phase difference between the first phase signal and the second phase signal selectively to modify an output voltage associated with the at least one of the plurality of radio frequency devices.

The plurality of transformers may include a first transformer and a second transformer, and the first transformer may include a first turns ratio that is different from the second turns ratio of the second transformer. The plurality of radio frequency devices may include a first radio frequency device and a plurality of second radio frequency devices, and the plurality of transformers may include a first transformer and a plurality of second transformers. The method may include coupling the first radio frequency device operatively to a primary winding of the first transformer, and coupling each of the plurality of second radio frequency devices operatively to a primary winding of one of the plurality of second transformers.

Each of the plurality of second transformers may include a turns ratio equal to one of n:1 and (n−1):1, where n represents a quantity of second radio frequency devices. Each of the plurality of second transformers may include a turns ratio equal to $2^n$:1, where n represents an increasing positive integer. The plurality of second radio frequency devices may include a first radio frequency device and a second radio frequency device, and the method may include coupling the first radio frequency device operatively to a first power supply, and coupling the second radio frequency device operatively to a second power supply.

The second power supply may be a variable power supply, and an output voltage associated with the first power supply may be greater than an output voltage associated with the second power supply. The output voltage associated with the second power supply may be twice an output voltage associated with the first power supply. At least one of the first power supply and the second power supply may include a rectifier.

Other embodiments will become apparent from the following detailed description considered in conjunction with the accompanying drawings. It is to be understood, however, that the drawings are designed as an illustration only and not as a definition of the limits of any of the embodiments.

BRIEF DESCRIPTION OF THE DRAWINGS

The following drawings are provided by way of example only and without limitation, wherein like reference numerals (when used) indicate corresponding elements throughout the several views, and wherein.

It is to be appreciated that elements in the figures are illustrated for simplicity and clarity. Common but well-understood elements that are useful or necessary in a commercially feasible embodiment are not shown in order to facilitate a less hindered view of the illustrated embodiments.

DETAILED DESCRIPTION

Methods to control radio frequency (RF) power are used in the field of RF induction heating and related RF heating fields. These methods use several power conversion steps to provide RF power, which include rectifying alternating current (AC) line power to a direct current (DC) voltage. These methods include monitoring the DC voltage or current to control power delivered to an RF stage, which is referred to as a gain stage or pre-regulator. Most of these methods include an intermediate gain stage that uses a full-power rated stage to vary the DC voltage or current to control the RF stage.

Figure 1:
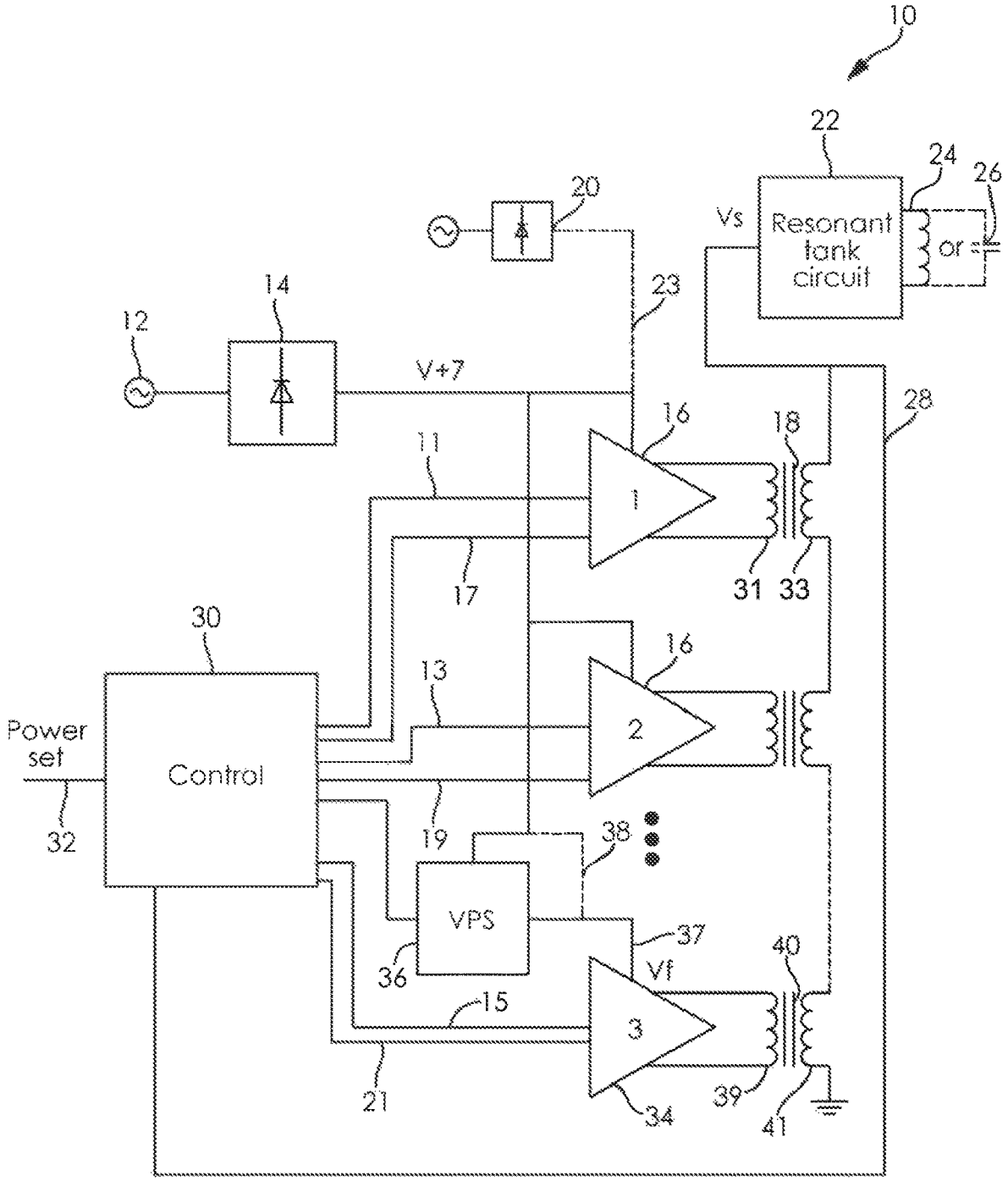
FIG. 1 is a block diagram showing a first embodiment of a radio frequency (RF) heating system using direct-digital RF control and fine-tune power control.

The embodiments disclosed herein are directed to a radio frequency induction heating apparatus 10 shown in FIG. 1 that uses direct-digital radio frequency (RF) power control and fine-tune power control. An alternating current (AC) power source 12 is applied to a direct current (DC) central rectifier 14, which results in a DC voltage V+ applied to a plurality of RF devices 16, 34. As an alternative to the central rectifier 14 for all of the RF devices 16, 34, a dedicated rectifier 20 may be coupled to each of the RF devices 16, 34, as shown by a dashed line 23 to the RF device 16.

Each of the plurality of RF devices 16, 34 is coupled to a transformer 18, 40, which has a secondary winding 33, 41 connected in series to generate an output voltage Vs. The output voltage Vs is used to drive a resonant tank circuit 22 that includes an induction heating coil 24 or corona discharge capacitor 26. A feedback signal 28 is used to monitor the output voltage Vs, current, and/or frequency at the input of the resonant tank circuit 22.

A control device 30 provides on/off control signals 11, 13, 15 to each RF device 16, 34, as well as RF frequency signals 17, 19, 21 to drive the RF devices 16, 34. The RF frequency signals 17, 19, 21 include two phases that are phase shifted with respect to each other. The frequency of the RF frequency signals are determined by a resonant frequency of the resonant tank circuit 22. The control device 30 provides closed-loop power control based on a power setting signal 32 and the feedback signal 28. A variable power supply (VPS) 36 optionally provides a variable controlled DC voltage 37 to the last RF device 34. In some embodiments, the VPS 36 is not used or removed from the apparatus 10, in which case the voltage is provided by the output voltage Vs to each of the RF devices 16, 34, as shown by bypass connection 38.

The last RF device 34 may be implemented differently than the remaining RF devices 16 and may have a unique transformer 40 with a different turns ratio than the remaining transformers 18. The last RF device 34 can include a plurality of lower power trim RF devices, each of which may have a transformer with a ratio that increases an effective RF device number associated with the apparatus 10.

The control device 30 controls the output power by using a combination of direct-digital RF power control for each RF device 16, 34 combined with one or more fine-tune power control methods including, but not limited to, phase-shift control and a variable power supply applied to the last power device 34. This combination of direct-digital power control and fine-tune power control offers an advantageous solution to controlling the power of the resulting induction heating system.

The embodiments disclosed herein directly control one or more RF devices to implement closed-loop power control rather than amplification or modulation of an external signal. In addition, the disclosed embodiments use fine-tune power control with direct-digital power control in induction heating applications. These features greatly reduce the overall number of RF devices used to achieve a desired power, which reduces system cost and improves overall efficiency.

The disclosed embodiments apply a direct-digital RF power control scheme combined with one or more fine-tune power control techniques to manage RF power without requiring additional gain stages. The disclosed embodiments allow operation with a variable RF frequency that tracks a resonance frequency of the resonant tank circuit 22. The feedback signal 28 provides a sample of the current at the resonance frequency of the resonant tank circuit 22. The voltage of the current sample is estimated by the control device 30 or can be sampled directly from the resonant tank circuit 22.

Tracking variable RF frequency uses the voltage of the resonant tank circuit 22, which is derived by the control device 30, and/or the current derived from the feedback signal 28 using a phased-locked loop (PLL) circuit, which may be implemented digitally, to track the resonance frequency of the resonant tank circuit 22. Thus, the disclosed embodiments achieve improved power control with fewer power stages and higher efficiency than conventional techniques.

As discussed above, FIG. 1 shows a radio frequency (RF) heating system 10 using a direct-digital RF power control method combined with one or more fine-tune control methods disclosed herein. The RF heating system 10 includes an AC power source 12 coupled to a DC rectifier 14, which provides a DC voltage V+ to the RF devices 16, 34. As an alternative to using one central DC rectifier 14 for each of the RF devices 16, 34, dedicated rectifiers 20, each of which may be coupled to one of the RF devices 16, 34 as shown by a dashed line 23 connected to the first RF device 16, may be substituted for the central rectifier 14.

Each of the plurality of RF devices 16, 34 is coupled to a primary winding 31, 39 of one of a plurality of transformers 18, 40. Secondary windings 33, 41 of the transformers 18, 40 are connected in series to provide the output voltage Vs. The output voltage Vs is used to drive a resonant tank circuit 22, which includes a work component, an induction heating coil 24, corona discharge capacitor 26, and/or the like. The resonant tank circuit 22 includes a series combination, parallel combination, and/or an alternative combination of resonant components. The feedback signal 28 is used to provide an alternating current sample to the control device 30, from which the voltage Vs, current amplitude, phase, and/or frequency is estimated by the control device 30.

A current transformer (CT) sensor may be used to obtain the feedback signal 28. CT sensors are used for measuring alternating electric current. CT sensors, together with voltage (or potential) transformers, are known as instrument transformers. If the current in a circuit is too high to apply directly to measurement instrumentation, the CT sensor provides a reduced current accurately proportional to the current in the circuit, which can be conveniently connected to measuring and recording instruments, such as the control device 30. The CT sensor isolates measurement instruments from a potentially high voltage in the circuit to be monitored.

Like any other transformer, the CT sensor has a primary winding, a magnetic core, and a secondary winding. Alternating current in the primary winding generates an alternating magnetic field in the core, which then induces an alternating current in the secondary winding. An essential objective of current transformer design is to ensure that the primary and secondary circuits are efficiently coupled so that the secondary current is linearly proportional to the primary current. The CT sensor includes a length of wire wrapped around a silicon steel ring applied to the circuit being measured. The primary winding includes, for example, a single turn of a conductor, with a secondary winding having multiple turns.

Figure 13A:
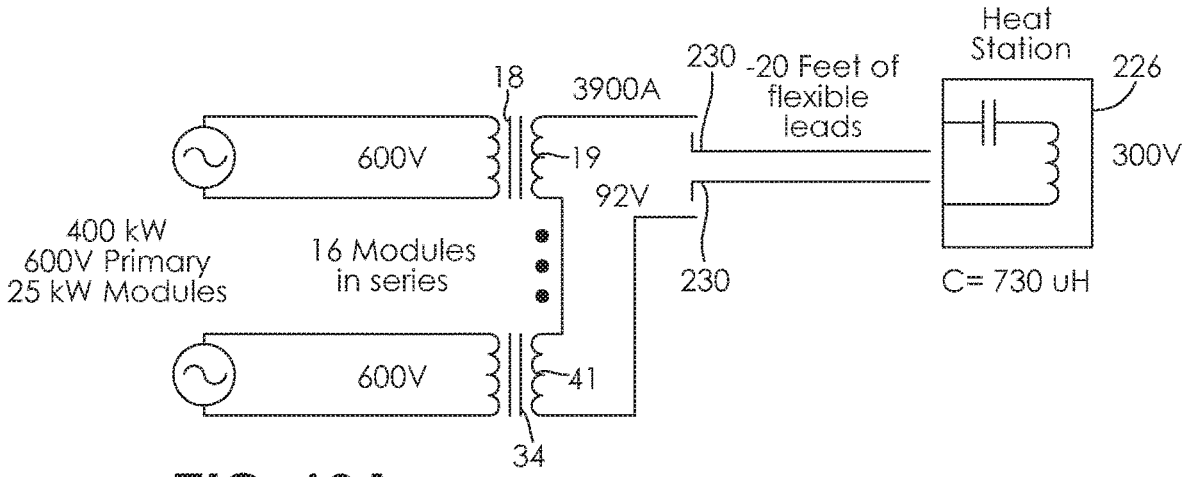
FIGS. 13A-B are block diagrams of two embodiments that couple a current transformer (CT) sensor in the RF heating system.
Figure 13B:
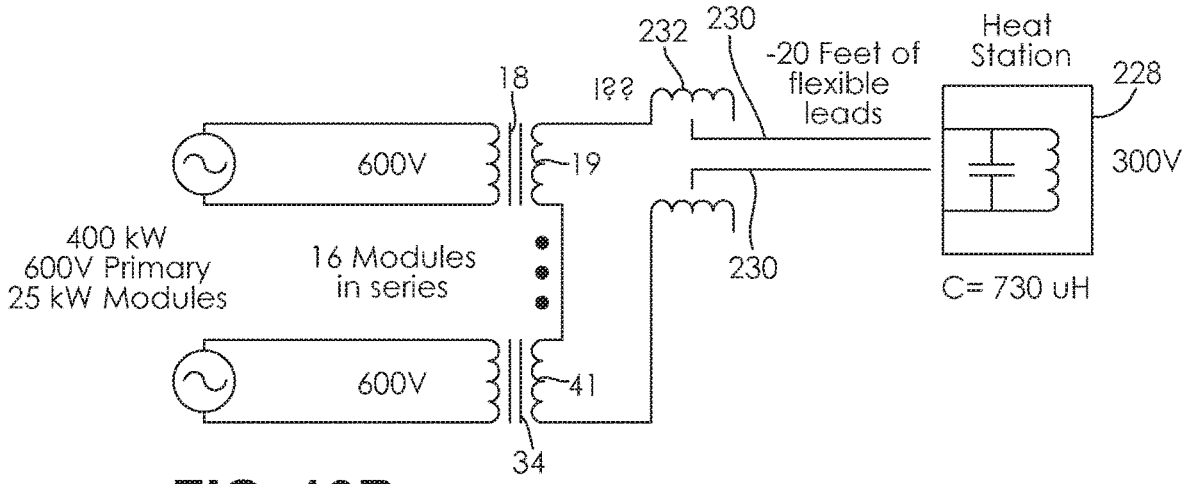

FIGS. 13A and 13B show two embodiments of the resonant tank circuit 226, 228. In FIG. 13A, the resonant tank circuit 226 is coupled to approximately twenty (20) feet of flexible lines 230 since the resonant tank circuit 226 is mobile. The flexible lines 230 are then coupled to the secondary windings 33, 41 of the transformers 18, 40. If the flexible lines 230 are configured to handle 4000A, the flexible lines 230 may become bulky, in which case water cooling is used. FIG. 13B shows another embodiment in which the flexible lines 230 are coupled to a transformer 232, which is then coupled to the secondary windings 33, 41 of the transformers 18, 40. In this embodiment, the flexible lines 230 do not carry as much current as in the embodiment shown in FIG. 13A.

In FIG. 1, the control device 30 provides a control signal 11, 13, 15 and an RF frequency signal 17, 19, 21 to each RF device 16, 34. The RF frequency signals 17, 19, 21 include two (2) channels, phase A and phase B, which are phase shifted with respect to each other. The frequency of the RF frequency signals 17, 19, 21 is determined by the resonance frequency of the resonant tank circuit 22 utilizing a variety of techniques, such as analog, digital, and/or hybrid PLL circuits. The control device 30 provides closed-loop power control based on the power setting signal 32 and the feedback signal 28. The power setting signal 32 is obtained from a user interface that allows setting of the power level. The power setting signal 32 can be an analog signal or a digital signal, which is provided to the control device 30 to provide a power reference value.

An embodiment that provides a variable controlled DC voltage to the last RF device 34 uses a variable power supply 36 as shown in FIG. 1. In some embodiments, the variable power supply 36 is not used, which is represented by the bypass connection 38.

The last RF device 34 may be implemented differently than the remaining RF devices 16 and can have a different transformer 40 with a different turns ratio than the remaining transformers 18. The last RF device 34 can also include lower power or trim devices, each of which has a different transformer ratio to further increase an effective RF device number. For multiple trim RF devices with different ratios, the effective RF number is equal to $Neff=2^n*(N+1)-1$, where N represents the number of RF devices 16 (i.e., N full steps) and n is the number of trim RF devices included in the last RF device 34 (i.e., n binary steps). An embodiment in which the last RF device 34 is substantially the same size as the remaining RF devices 16, and the VPS 36 is set to half of Vs, would result in Neff=2N.

The control device 30 controls output power of the RF heating system 10 by utilizing a combination of independent, direct-digital RF power control to each RF device 16, 34 combined with one or more fine-tune power control methods including, but not limited to, phase-shift control and trim variable power supply control of the last power device 34. This combination of direct-digital power control and fine-tune power control provides a substantially improved solution for controlling the power of the RF heating system.

The RF devices or amplifiers 16, 34 may include a plurality of solid-state technologies, such as silicon controlled rectifiers (SCR), insulated-gate bipolar transistors (IGBT), and metal-oxide semiconductor field effect transistors (MOSFET) configured in a variety of topologies including, but not limited to, a full bridge amplifier, half bridge amplifier, class A amplifier, class AB amplifier, class C amplifier, and/or class D amplifier circuit. The RF devices 16, 34 are typically implemented as a class D, full bridge amplifier, but other topologies can also be used. The transistors used can vary widely from metal oxide semiconductor field effect transistor (MOSFET) or insulated gate bipolar transistor (IGBT) designs to newer switching semiconductors. A typical device used is the HiperFET power MOSFET Q3-Class, part number IXFB44N100Q3, which is available from IXYS Corporation, 1590 Buckeye Drive, Milpitas, Calif. 95035, 408 457 9000, www.ixys.com.

The transformers 18, 40 are typically implemented with a M:1 or M:0.5 ratio having multiple primary windings and a single-turn or half-turn secondary winding. Ratios can vary to allow for proper impedance matching of the RF device 16, 34 to the output circuit or resonant tank circuit 22. Typical ratios include 2:1 to 40:1.

The control device 30 provides the control signals 11, 13, 15 and RF frequency signals 17, 19, 21 independently to each RF device 16, 34, each of which then generates an RF drive voltage that is applied to the primary windings 21, 39 of the corresponding transformer 18, 40. The control device 30 provides a closed-loop power control system by comparing the feedback signal 28 with the power setting signal 32 to determine the level of power required. The control device 30 operates by selectively activating RF power devices 16, 34 using the control signals 11, 13, 15 as needed. The signals 17, 19, 21 can be the same or different signals. However, the RF devices 16, 34 are controlled independently with the on/off control signals 11, 13, 15.

Figure 14:
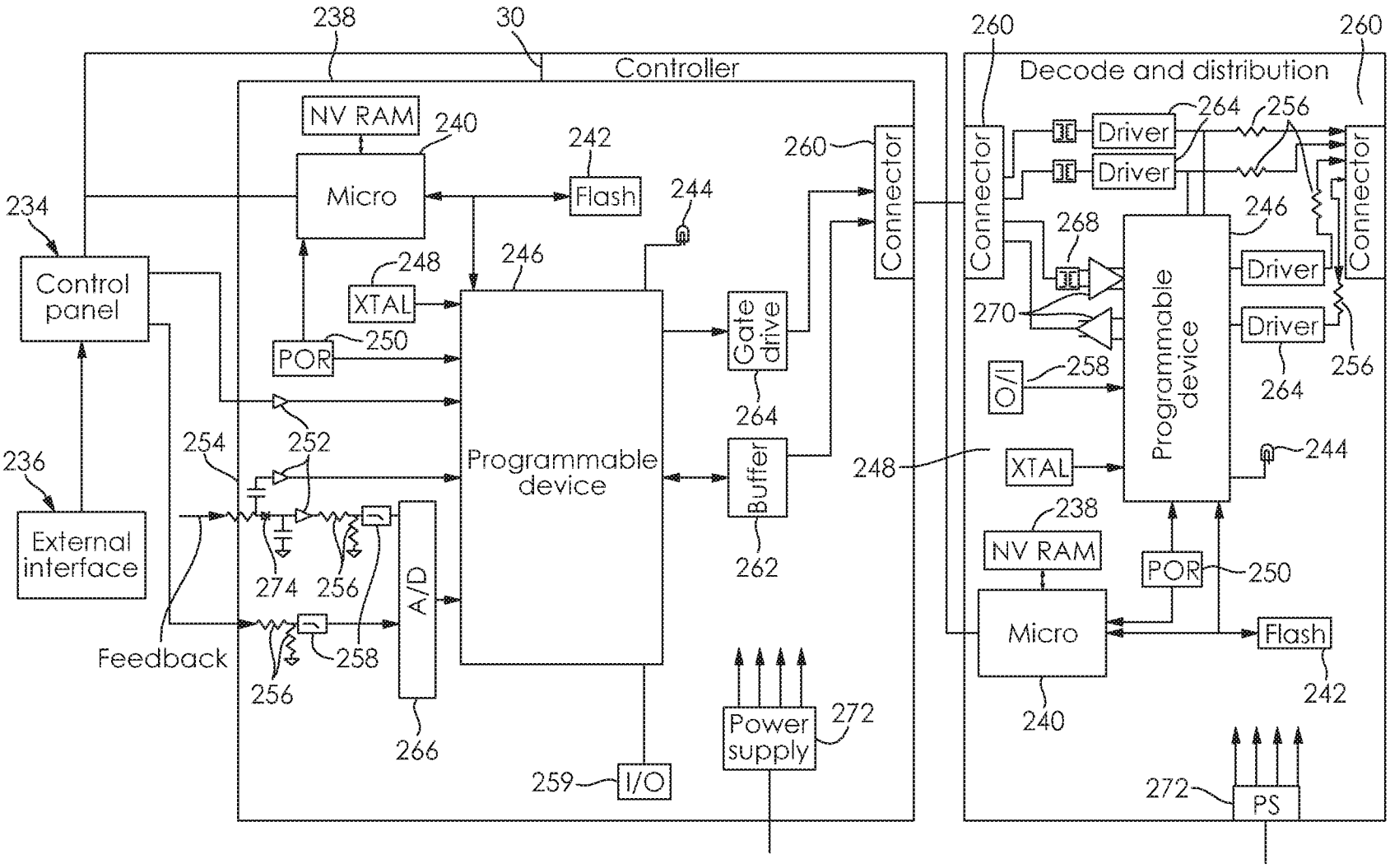
FIG. 14 is a block diagram of a control device used in the RF heating system.

A block diagram of the control device 30 is provided in FIG. 14. The control device 30 includes a control panel 234, external interface 236, non-volatile random access memory (NV RAM) 238, microprocessors 240, flash memory 242, light emitting diodes 244, field programmable gate arrays (FPGA) 246, oscillators 248, power-on-reset circuits (POR) 250, buffers 252, capacitors 254, resistors 256, low pass filters 258, external connectors 260, buffers 262, drivers 264, analog-to-digital converter 266, transformer 268, operational amplifiers 270, simple switcher 272, and inverters 274.

Figure 2:
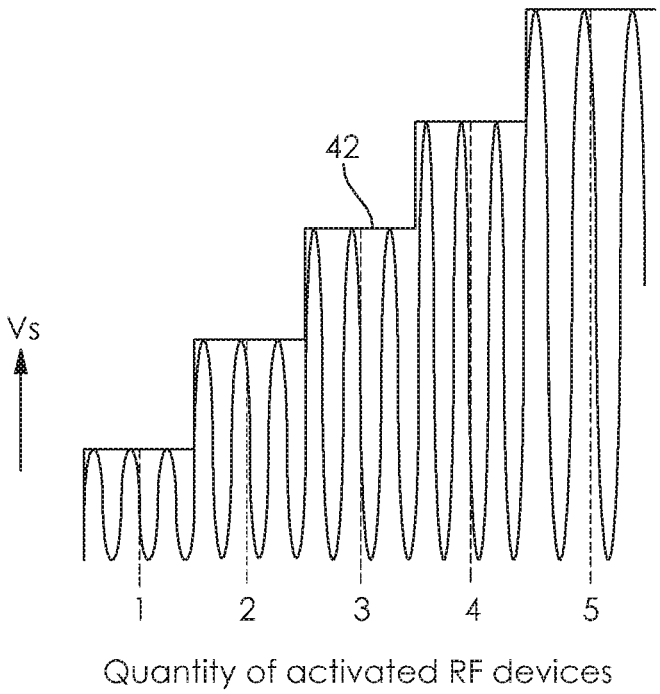
FIG. 2 is a graph of output voltage as a function of a quantity of activated RF devices using direct-digital RF control and fine-tune power control in the RF heating system.
Figure 3:
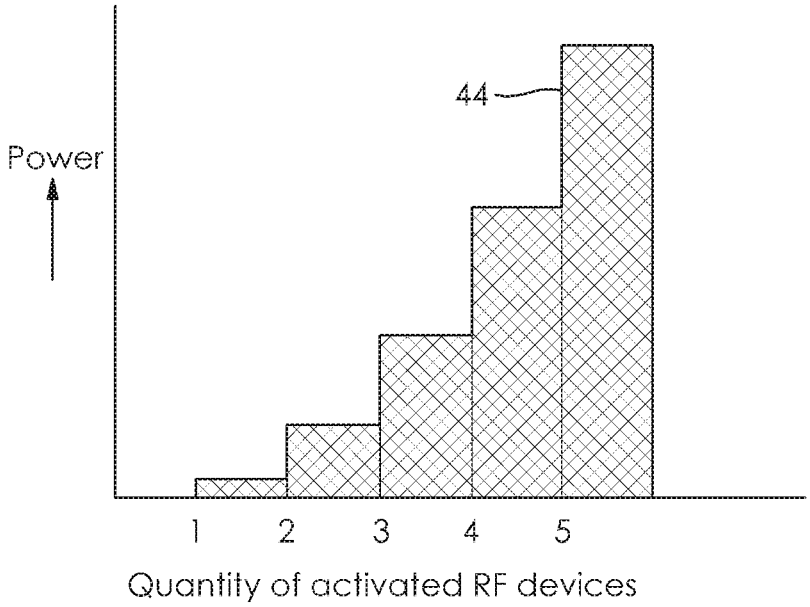
FIG. 3 is a graph of output power as a function of the quantity of activated RF devices using direct-digital RF control and fine-tune power control in the RF heating system.

FIG. 2 shows the output voltage Vs, which is an AC voltage, of the RF heating system 10 as a function of the quantity of RF power devices 16, 34 that have been activated. Each of the RF devices 16 provides a substantially equivalent output voltage step. By selectively activating individual RF devices 16, 34, the output voltage Vs is stepwise modified. The output power, as shown in FIG. 3, varies in proportion to the square of the output voltage Vs. When a modification in power is required as determined by the control device 30, the correct identity and/or quantity of RF devices 16, 34 is activated.

Power control using direct-digital RF control of the RF devices 16, 34 is implemented with the plurality of RF devices 16, 34 to produce a sufficiently fine power control. As shown in FIG. 3, using five (5) RF devices, power steps 44 are relatively coarse. However, using a larger quantity of RF devices may be too costly for many applications. Accordingly, the disclosed embodiments use a variety of techniques to combine direct-digital RF power control of RF devices with one or more methods of fine-tune power control to achieve a finer resolution of power control.

Figure 4A:
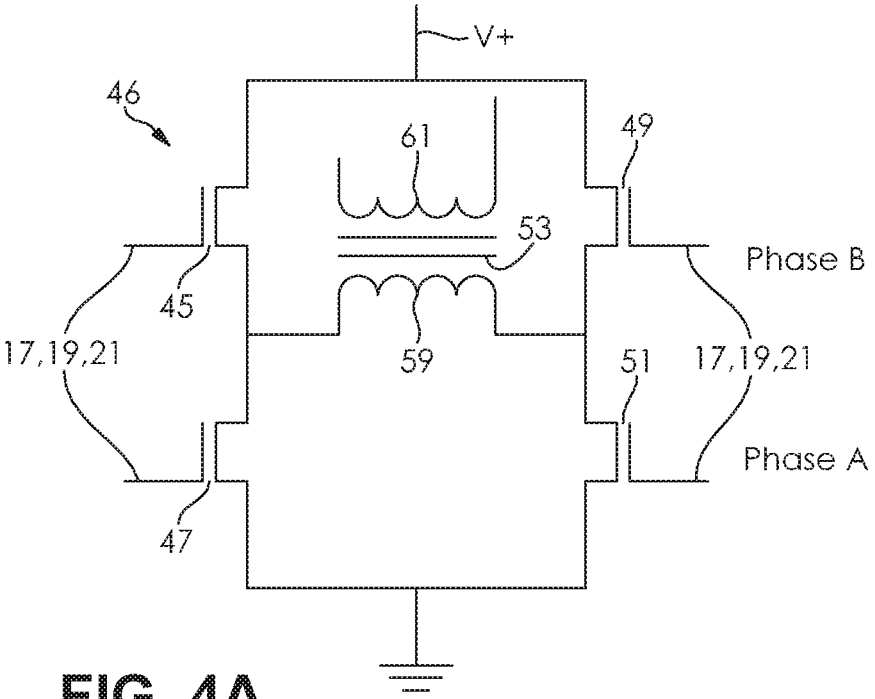
FIG. 4A is a diagram of a phase-shift circuit that provides fine-tune power control in the RF heating system.
Figure 4B:
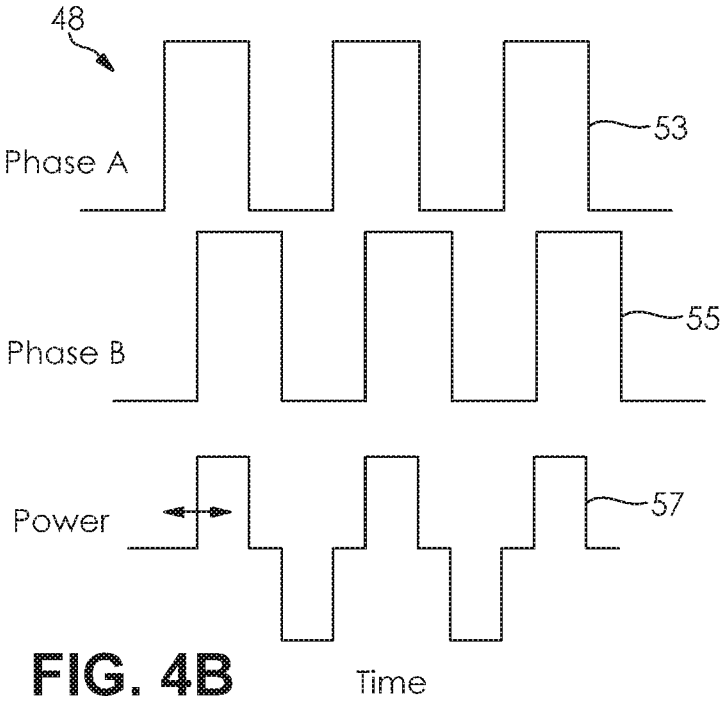
FIG. 4B shows phase control signals and an output power signal associated with the phase-shift circuit shown in FIG. 4A.

One embodiment for fine-tune power control is shown in FIGS. 4A and 4B. By applying phase shift control of the RF devices 16, 34, fine-tune power control can be achieved without requiring additional components. A full bridge inverter 46 shown in FIG. 4A is implemented as the RF device topology in this embodiment, which could also be implemented using alternative inverter topologies. The full bridge inverter 46, which can be implemented as the last RF device 34 shown in FIG. 1, includes field effect transistors 45, 47 connected in series between a positive voltage V+ and ground, and field effect transistors 49, 51 connected in series between the positive voltage V+ and ground. The primary winding 59 of a transformer 53, which can be the last transformer 40 shown in FIG. 1, is connected in series across a node disposed between field effect transistors 45, 47 and a node disposed between field effect transistors 49, 51. The voltage Vs is obtained across the secondary winding 61 of the transformer 53. FIG. 4B shows waveforms 48 including a phase A signal 53 from the control device 30, which is coupled to gate terminals of field effect transistors 45, 51, a phase B signal 55 from the control device 30, which is coupled to gate terminals of field effect transistors 47, 49, and a power signal 57, which is provided across the secondary winding 59 of the transformer 53. The phase A signal 53 and phase B signal 55 are combined to provide a magnitude of the power signal 57. The phase A signal 53 and phase B signal 55 are modulated in phase with respect to each other to control the transfer of power from the output of the RF device 46.

When combining direct-digital RF control with phase-shift control, as an implementation of fine-tune power control, the value of the phase shift depends on the quantity of RF devices being activated. Power is a function of the square of the output voltage $Vs^2$. In a system having five (5) RF devices, if one (1) RF device is activated, the total power is approximately 4%. With one RF device activated, 100% of the output of that RF device is controlled, so that the phase is shifted by 0-180 degrees. If a second RF device is added, the total power is increased to 18%, but only the incremental power difference, which is approximately 12%, is controlled with the phase control. That is, approximately 70% of the total power is controlled with the phase control or about 0-120 degrees. Once 120 degrees, or 4% of the total power, is obtained, a single RF device can be used.

As additional RF devices are used, the change in power that is controlled decreases as a ratio of the total power at a given number of RF devices, and thus the phase angle used to control those RF devices decreases as a result. As five (5) RF devices are activated, 45% of the power range is controlled with phase control, or only 78 degrees of phase shift.

Figure 5:
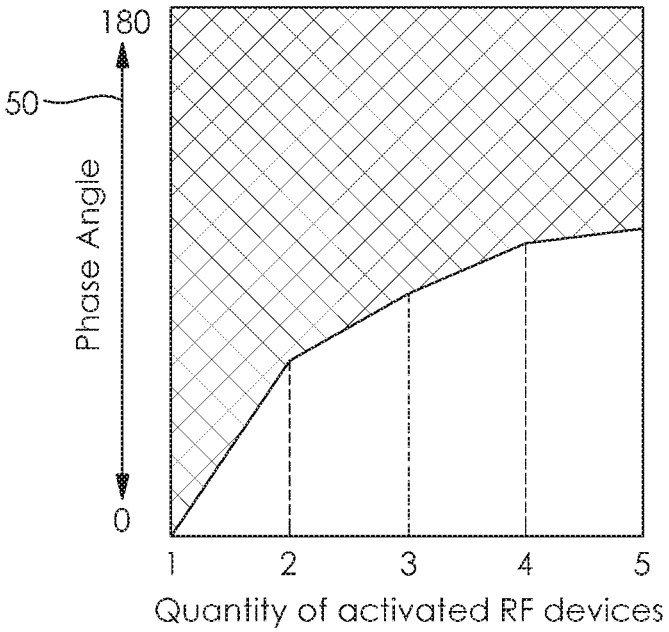
FIG. 5 is a graph of phase angle as a function of the quantity of activated RF devices in the RF heating system.

As additional RF devices are activated, this difference decreases with each incremental step. FIG. 5 shows a relative phase shift angle as a function of the quantity of RF devices activated. The phase angle range 50 decreases as additional RF devices are activated. This feature allows for a significant reduction in power loss by reducing the phase angle range at higher power, which represents a substantial improvement over conventional techniques.

Figure 6:
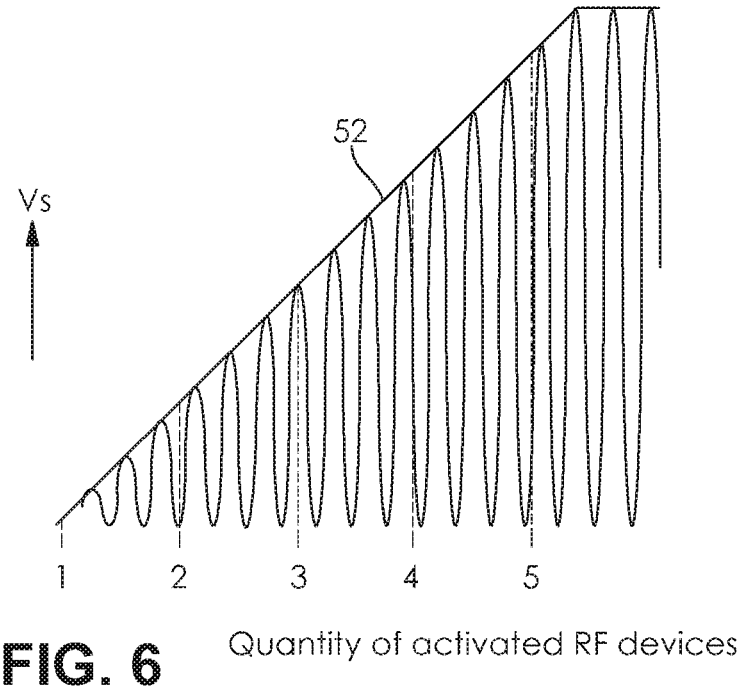
FIG. 6 is a graph of output voltage as a function of the quantity of activated RF devices in the RF heating system.

FIG. 6 shows a smoothed output voltage Vs achieved by using the direct-digital RF control with phase-shift control. As shown in FIG. 6, the large voltage steps shown in FIG. 3 have been eliminated without using additional RF devices. Thus, this embodiment enables the use of fewer RF devices to achieve finer power control when compared with embodiments in which only direct-digital RF control is used. Accordingly, in this embodiment, losses experienced when switching large amounts of RF power with high phase angles is avoided by using phase-shift control.

Figure 7A:
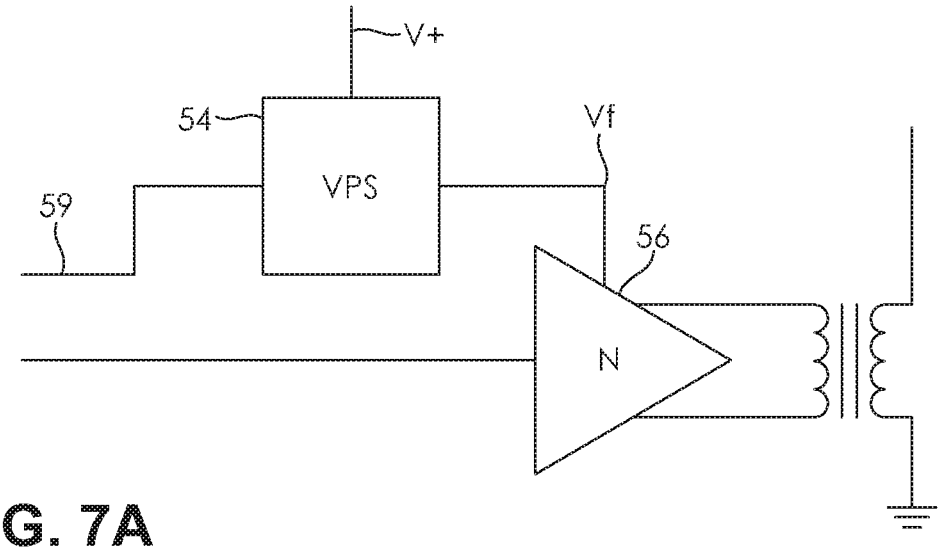
FIG. 7A is a block diagram of a circuit utilizing a variable power supply (VPS) to provide fine-tune power control in the RF heating system.
Figure 7B:
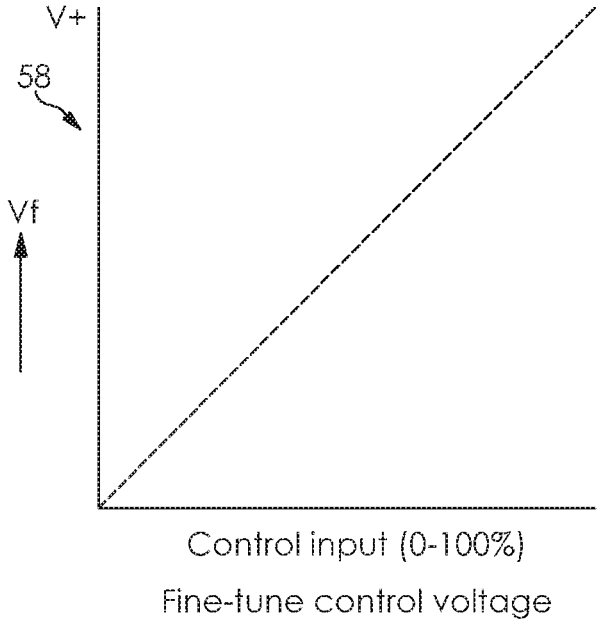
FIG. 7B is a graph of output voltage from the VPS as a function of a control signal.

Another fine-tune power control method is shown in FIGS. 7A and 7B. This method utilizes the variable power supply (VPS) 54 to control a level of DC voltage applied to the RF device 56, which can be implemented as the last RF device 34 shown in FIG. 1. The VPS 54 can be implemented using any topology that allows for control of the output DC voltage Vf. The control device 30 shown in FIG. 1 controls the VPS 54 directly, thereby controlling the output voltage of the RF device 56, as shown in a graph 58 of variable voltage Vf as a function of fine-tune control voltage 59 provided to the VPS 54 in FIG. 7B.

Figure 8:
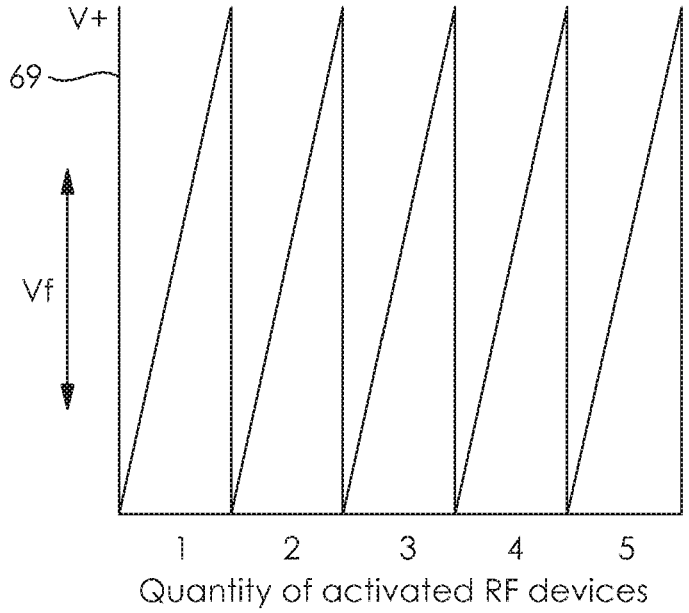
FIG. 8 is a graph of output voltage from the VPS as a function of the quantity of activated RF devices in relation to use of the circuit shown in FIG. 7A in the RF heating system.
Figure 9:
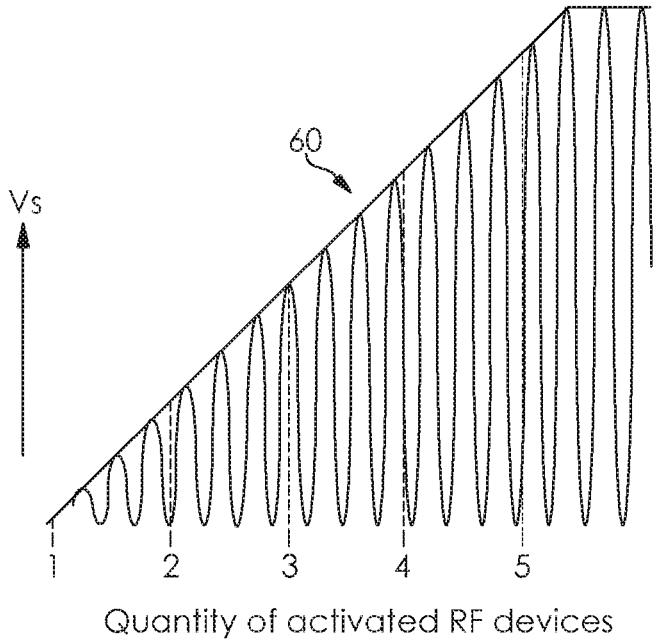
FIG. 9 is a graph of output voltage as a function of the quantity of activated RF devices in relation to use of the circuit shown in FIG. 7A in the RF heating system.

FIG. 8 shows a graph 69 of the variable voltage Vf applied to the RF device 56 shown in FIG. 7A as a function of the quantity of RF devices activated. This embodiment provides a smooth output voltage Vs ramp shown in FIG. 9 as more or fewer RF devices are activated. This embodiment also provides an improvement over other techniques by requiring fewer RF devices to achieve greater resolution in power control. The VPS 54 is rated as 1/N times the overall power rating of the RF devices, where N represents a total quantity of RF devices, which provides a significant reduction when compared with other implementations that do not combine direct-digital RF control with the variable power supply control. Reducing the size and power of the VPS 54 improves overall system efficiency, reduces system cost, and reduces the quantity of stored energy components in the VPS 54.

Figure 10A:
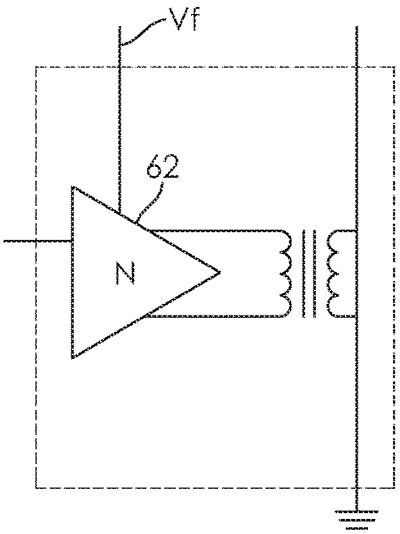
FIG. 10A is a block diagram of a portion of the RF heating system showing a last RF device and transformer.
Figure 10B:
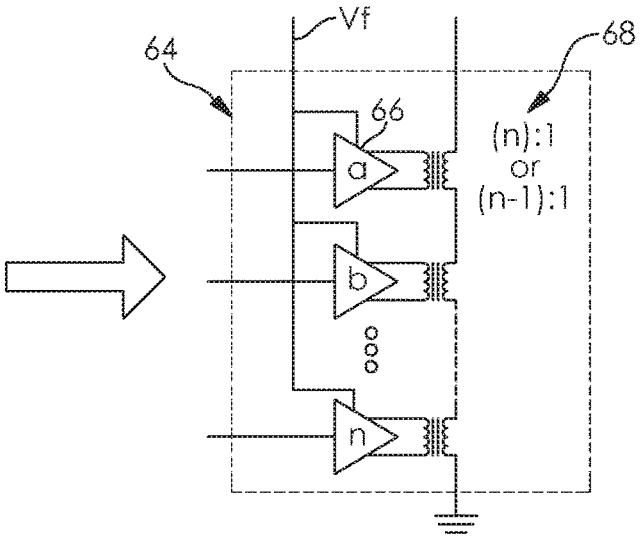
FIG. 10B is a block diagram of trim RF devices and transformers that are substituted for the last RF device and transformer shown in FIG. 10A in the RF heating system.
Figure 10C:
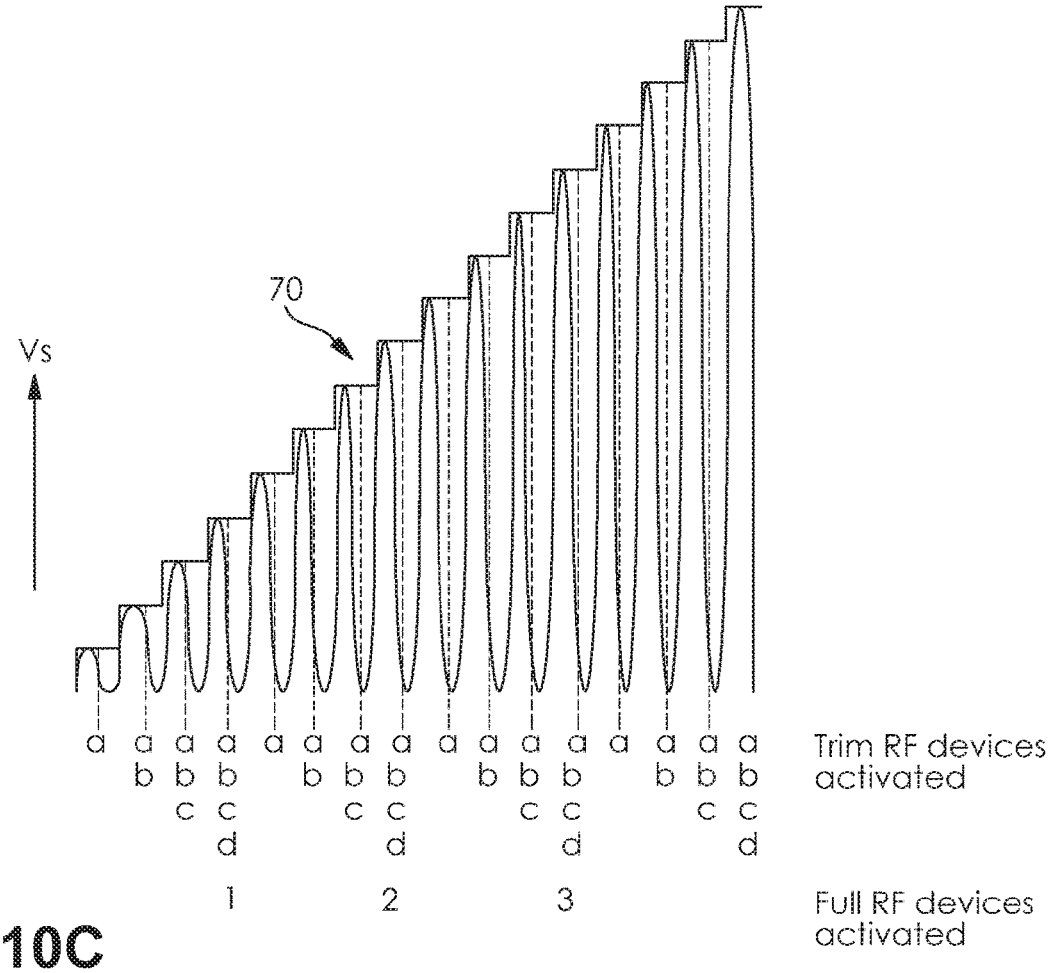
FIG. 10C is a graph of output voltage as a function of the quantity of activated RF devices in relation to use of the circuit shown in FIG. 10B in the RF heating system.

FIG. 10B shows an embodiment that can be used alone or in combination with the disclosed embodiments. The RF device 62 shown in FIG. 10A, which can be the last RF device 34 shown in FIG. 1, is replaced with a plurality of n trim RF devices 66 shown in FIG. 10B. Each RF device 64 is coupled to a corresponding transformer 68, which provides 1/n or 1/(n−1) times the voltage of the RF device 62 shown in FIG. 10A. The RF devices 66 are referred to as trim devices and shown as four devices in FIG. 10B, but can be implemented using any quantity of trim devices. The trim devices 66 are used with larger RF devices 16 shown in FIG. 1 to multiply the effective quantity of RF devices. The effective quantity of direct-digital RF devices Neff is provided by Neff=(N+1)*n, where N represents the quantity of RF devices 16 (i.e., N full steps) and n represents the quantity of trim RF devices in the last RF device 34 (i.e., n steps). Thus, for three (3) large total steps with four (4) trim steps, the effective quantity of RF devices Neff is equal to sixteen (16). This is shown in FIG. 10C, which combines smaller and larger steps to increase the effective number of steps 70. This embodiment provides the advantage of improving power control by reducing the quantity of full-size steps and increasing the quantity of smaller steps. If the step size is adequate for power control, the step can be utilized by itself or combined with other fine-tune power control methods disclosed herein.

Figure 11A:
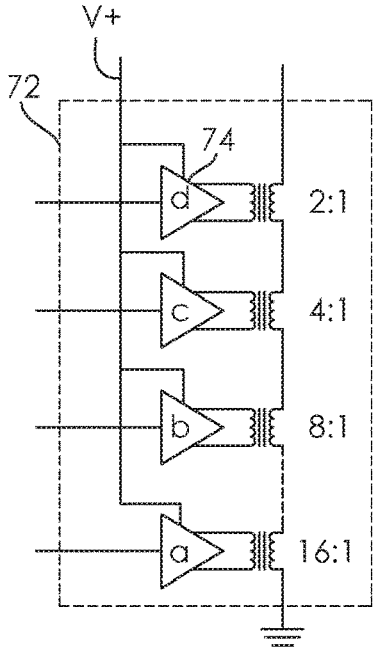
FIG. 11A is a block diagram of trim RF devices with binary weighting substituted for the last RF device shown in FIG. 10A.
Figure 11B:
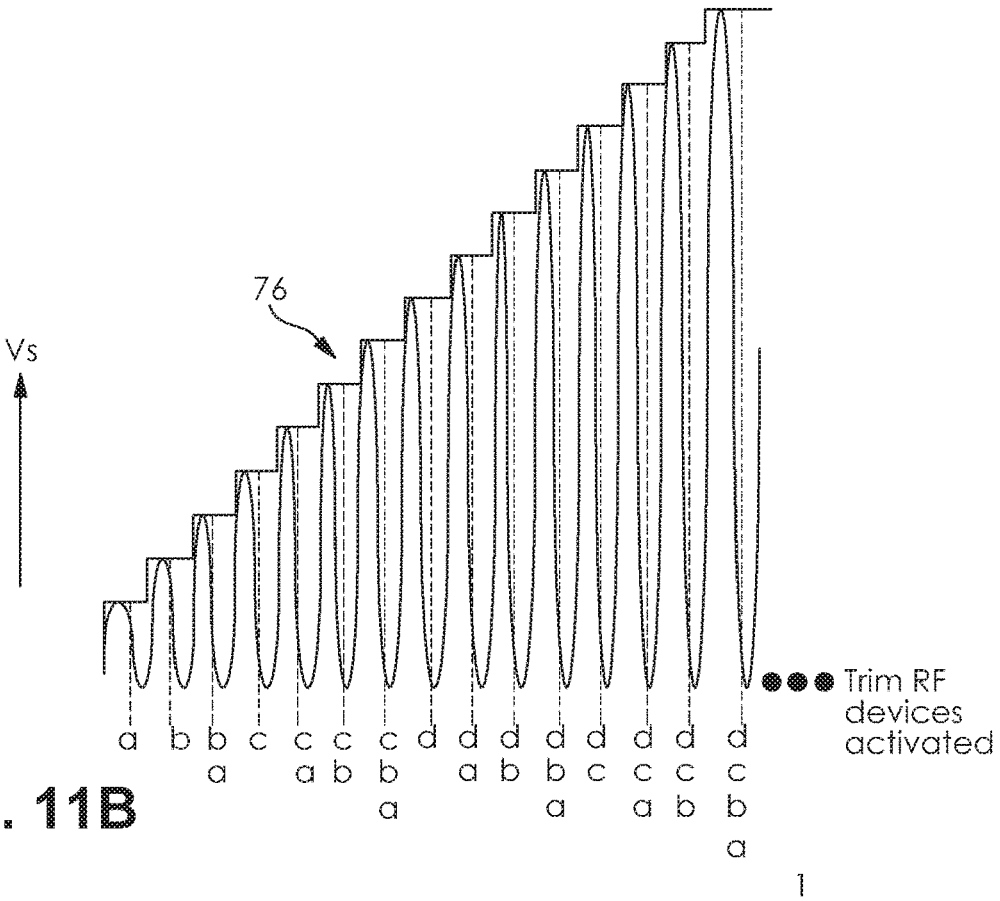
FIG. 11B is a graph of output voltage as a function of the quantity of activated RF devices in relation to use of the circuit shown in FIG. 11A in the RF heating system.

FIG. 11A shows another embodiment, in which the trim RF devices 74 have a transformer ratio that is binary-weighted, as shown in a four-device configuration 72. Thus, the transformer ratios are provided as 2:1, 4:1, 8:1, and 16:1 in this embodiment or, in general, $2^n$:1, where n is an increasing positive integer. The trim RF devices 74 are combined in all possible combinations to further increase the effective quantity of RF devices as shown along the horizontal axis in FIG. 11B. For the same three (3) RF devices and four (4) trim RF devices configuration, an effective quantity of RF devices of forty-five (45) is achieved without requiring additional RF devices. More generally, Neff=2n*(N+1)−1. Another embodiment includes the binary-weighted configuration depending on tradeoffs between RF device cost and power control resolution. When combined with phase-shift control shown in FIG. 4A, this embodiment has the effect of reducing the phase angle range by the effective quantity of RF devices Neff, thereby further improving system efficiency. When combined with the trim variable power supply embodiment shown in FIG. 7A, this embodiment enables the use of a lower power VPS, thus further reducing the cost of implementation. The binary-weighted embodiment also uses lower-power, and thus smaller, stored energy components.

Figure 12:
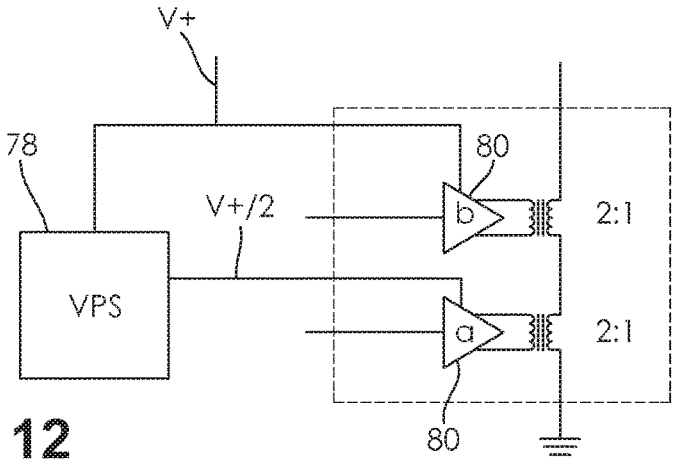
FIG. 12 is a block diagram of a circuit utilizing a VPS to control the trim RF devices with binary weighting.

FIG. 12 shows another embodiment that utilizes a VPS 78 to provide a fixed voltage equal to half the voltage V+, which feeds one of the trim RF devices 80 with half of the voltage V+. This embodiment enables both transformer ratios associated with the trim RF devices 80 to be the same, which increases RF device reuse yet maintains the same effective quantity of RF devices (Neff=2n*(N+1)−1) as in the binary-weighted embodiment.

Figure 16:
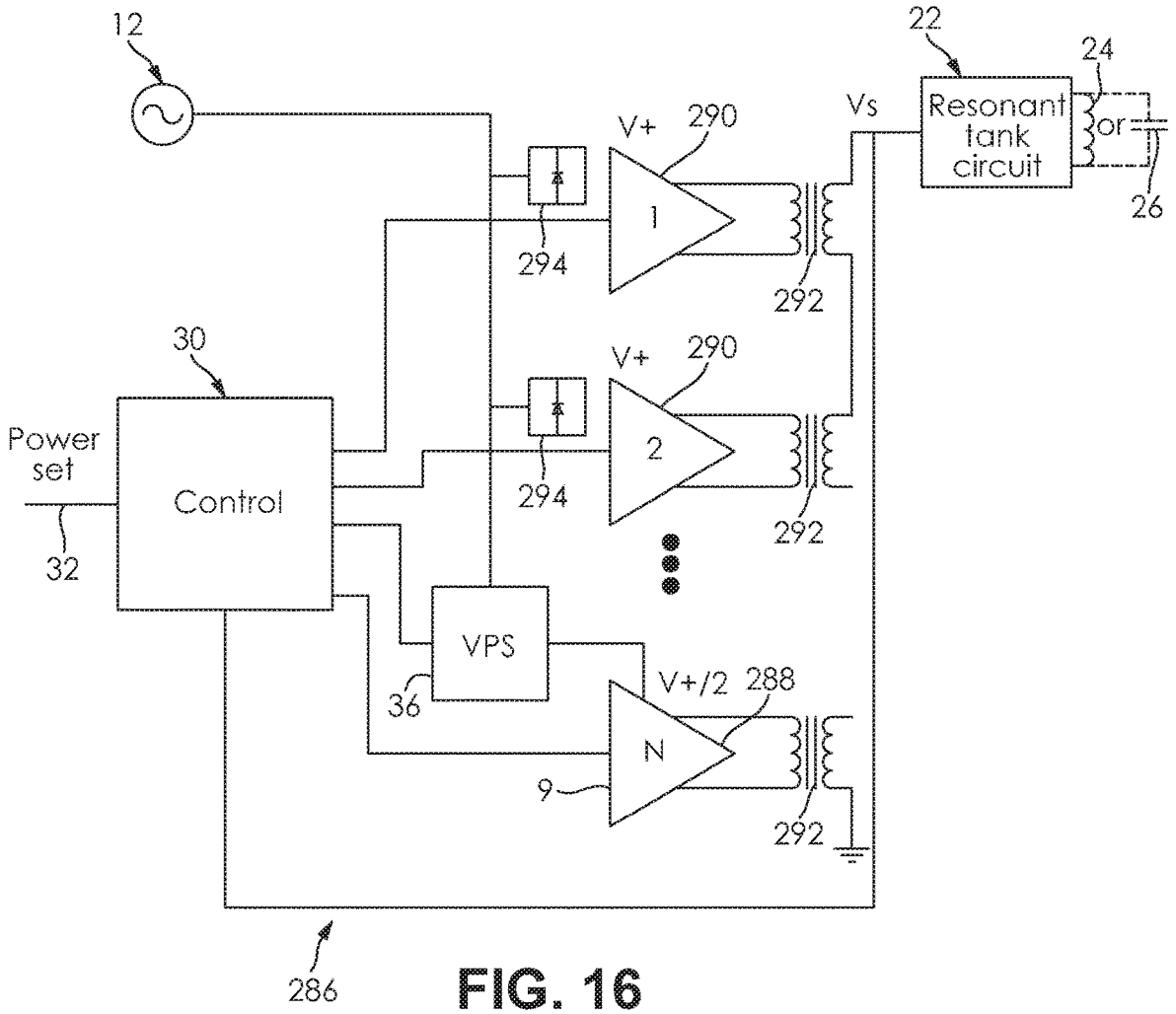
FIG. 16 is a block diagram showing another embodiment of the radio frequency (RF) heating system using direct-digital RF control and fine-tune power control.

FIG. 16 shows a block diagram of another embodiment 286 of the radio frequency (RF) heating system using direct-digital RF control and fine-tune power control. In this embodiment 286, a single trim RF device 288 is used that is substantially equivalent to the remaining RF devices 290 with the same transformer ratios for each of the transformers 292. However, the trim RF device 288 is provided with half of the input voltage that is provided to the remaining RF devices 290. This embodiment effectively doubles the RF device count. For example, using this embodiment with five (5) RF devices, the equivalent resolution of a nine (9) RF device system is achieved. This embodiment includes a dedicated rectifier 294 that provides ac-to-dc conversion for each RF device 290, which can also be combined with phase-shift control, as discussed hereinabove.

Figure 15A:
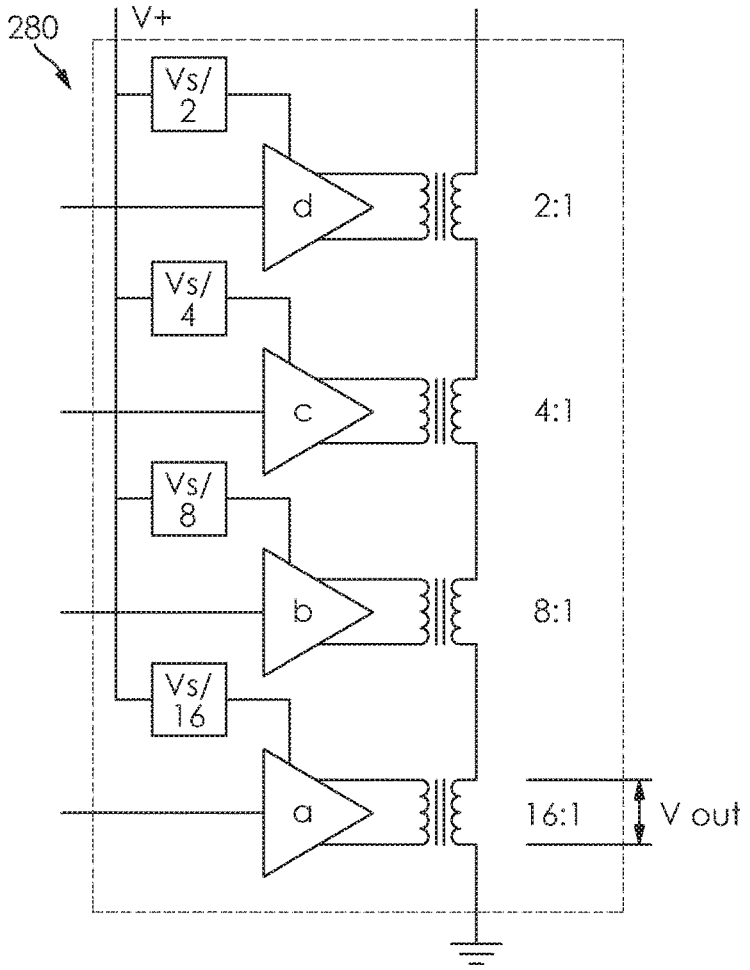
FIG. 15A is a block diagram of trim RF devices with binary weighting substituted for the last RF device shown in FIG. 10A.
Figure 15B:
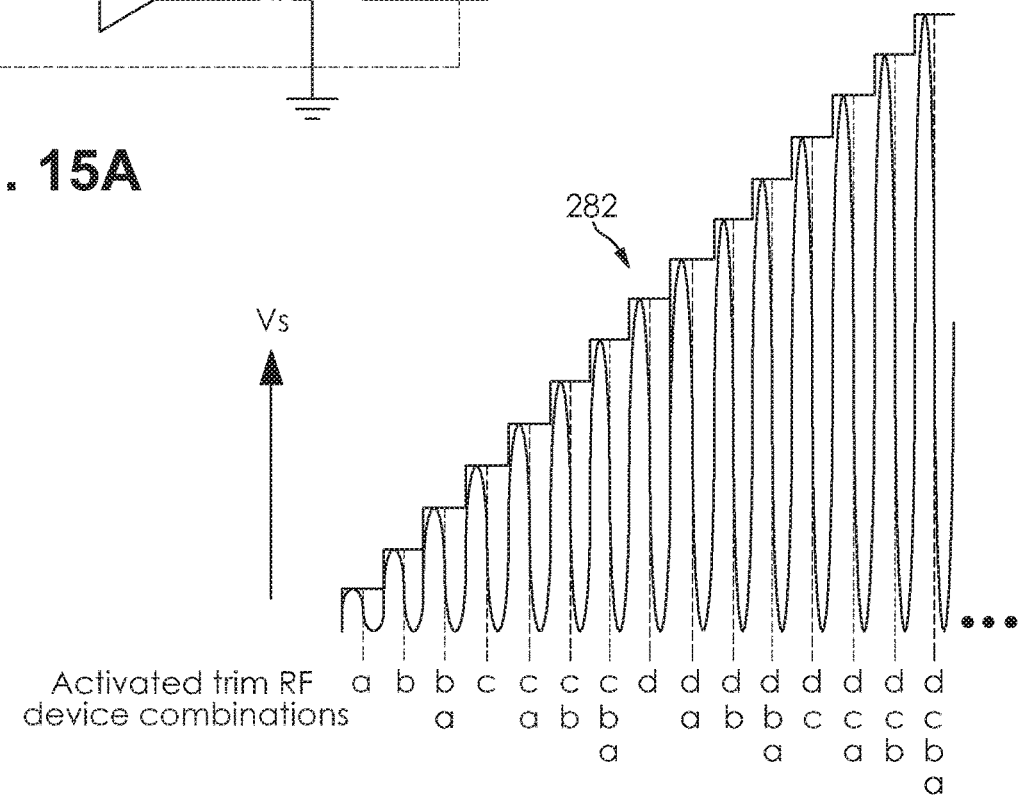
FIG. 15B is a graph of output voltage as a function of the quantity and identity of activated RF devices in relation to utilization of the circuit shown in FIG. 15A in the RF heating system.

These embodiments can be combined even further by adding additional devices with weighted transformer ratios and/or additional voltages to increase the effective device number. The input voltage can be adjusted to a binary ratio of the input voltage in a 1:1 ratio, which is the same ratio as that used with the RF devices 290, or the transformer ratio can be adjusted to a binary weighted ratio of the RF devices 290. The output voltage of each is equal to the input voltage divided by the ratio, so either the input voltage or the transformer ratio can be adjusted to obtain the same net effect, as shown in the configuration 280 of FIG. 15A and the corresponding graph 282 of output voltage Vs as a function of the quantity of activated RF devices shown in FIG. 15B. This embodiment can also be combined with phase-shift control to achieve greater control resolution by adding the phase-shift control to the RF signal as discussed above.

Another embodiment, which is also based on FIG. 16, is directed to fine-tune control with direct digital control and includes pulse controlling the on/off control signals, and thus the RF duty cycle of the RF output, for one or more RF devices 290. This embodiment includes modifying the duty cycle of the last RF device 288 for fine-tune control, however, the duty cycle of the on/off control signals can be modified prior to application to any one or more of the RF devices 288, 290.

Figure 17:
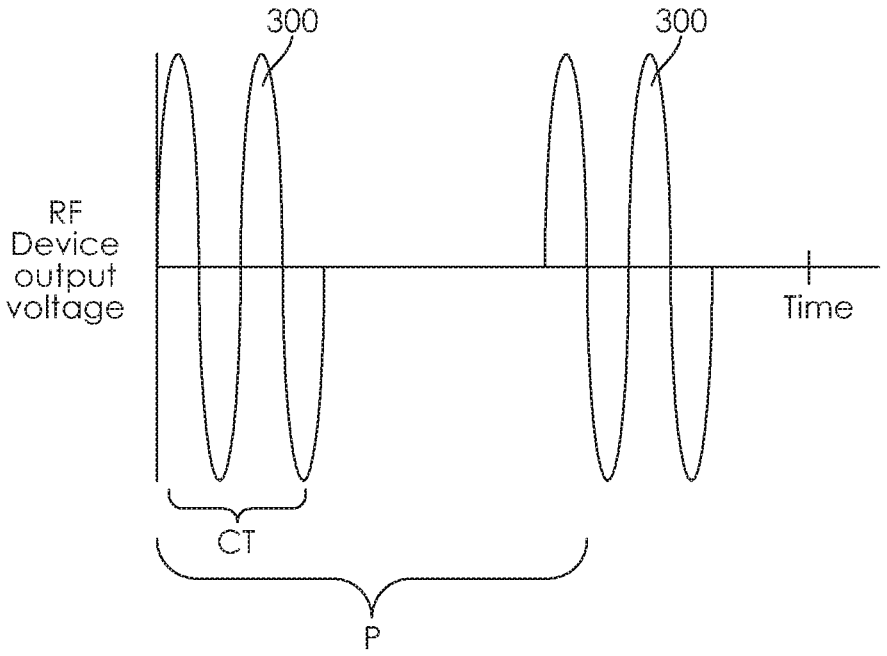
FIG. 17 is a graph of output voltage of one of the RF devices as a function of time.

FIG. 17 is a graph of the output voltage of one of the RF devices 288, 290, in which the output voltage is a pulsed RF signal 300 due to the duty cycle of the on/off control signal being applied to one of the RF devices 288, 290. The duty cycle is equal to an on-time T of the pulsed RF signal 300 divided by a duration of a period P of the pulsed RF signal 300 or $$\text{Duty Cycle}=T/P. \tag{1}$$

A minimum on-time of the RF device 288, 290 is provided by $$T\text{min}=1/f, \tag{2}$$

where f is the operating frequency. This embodiment enables on/off control of each RF device 288, 290 on a cycle-by-cycle basis, which allows for control of the duty cycle of any or all RF devices 288, 290 as long as Tmin is equal to or greater than one period of the pulsed RF signal 300. If Tmin is less than one period of the pulsed RF signal 300, switching losses of the RF device 288, 290 are increased. The period P should be greater than or equal to ten times the on-time T to enable reasonable resolution of power control. Increasing the period P to one hundred times the on-time or greater would enable more accurate control of the voltage.

There is a tradeoff between resolution of the voltage control and response time of the power control. The control bandwidth BW is limited by the following equation and should be equal to or greater than the overall control bandwidth of the control system as provided by the following equation:

$$\text{BW}=f*T\text{min}/P. \tag{3}$$

Figure 18:
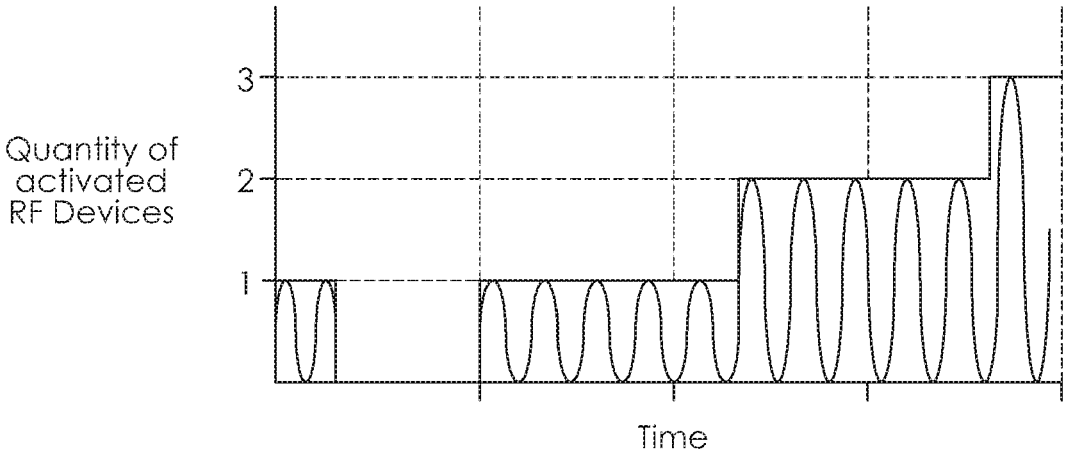
FIG. 18 is a graph of output voltage as a function of the quantity of activated RF devices.

In order to control the output voltage Vs, the duty cycle and quantity of activated RF devices 288, 290 are controlled. In the graph of FIG. 18, which shows the output voltage as a function of the quantity of activated RF devices, the number of steps and the duty cycle of the last RF device are controlled. The output voltage Vs will have some ripple based on the duty cycle of the pulsed RF signal 300. In heating applications, a key parameter is the average power transferred to an item to be heated. The impulse effect on the output voltage Vs is averaged, and thus will not affect heating to a great degree.

The output voltage Vs and output power Pout are determined from the following equations:

$$Vs=(N-1)*V+\text{duty cycle}*V, \tag{4}$$

$$P\text{out}=((N-1)*V+\text{duty cycle}*V)^2*R, \text{ and} \tag{5}$$

$$P\text{out}=Vs^2*R, \tag{6}$$

where N represents the quantity of activated RF devices (N=1 to Neff), V represents a secondary voltage associated with the lowest power RF device 288, 290, and R represents a resistance of the heating element 24, 26. As discussed above, the effective RF device number Neff is given by the following equation:

$$N\text{eff}=2n*(N+1)-1, \tag{7}$$

where n represents a quantity of binary steps, and N represents a quantity of full steps.

Figure 19:
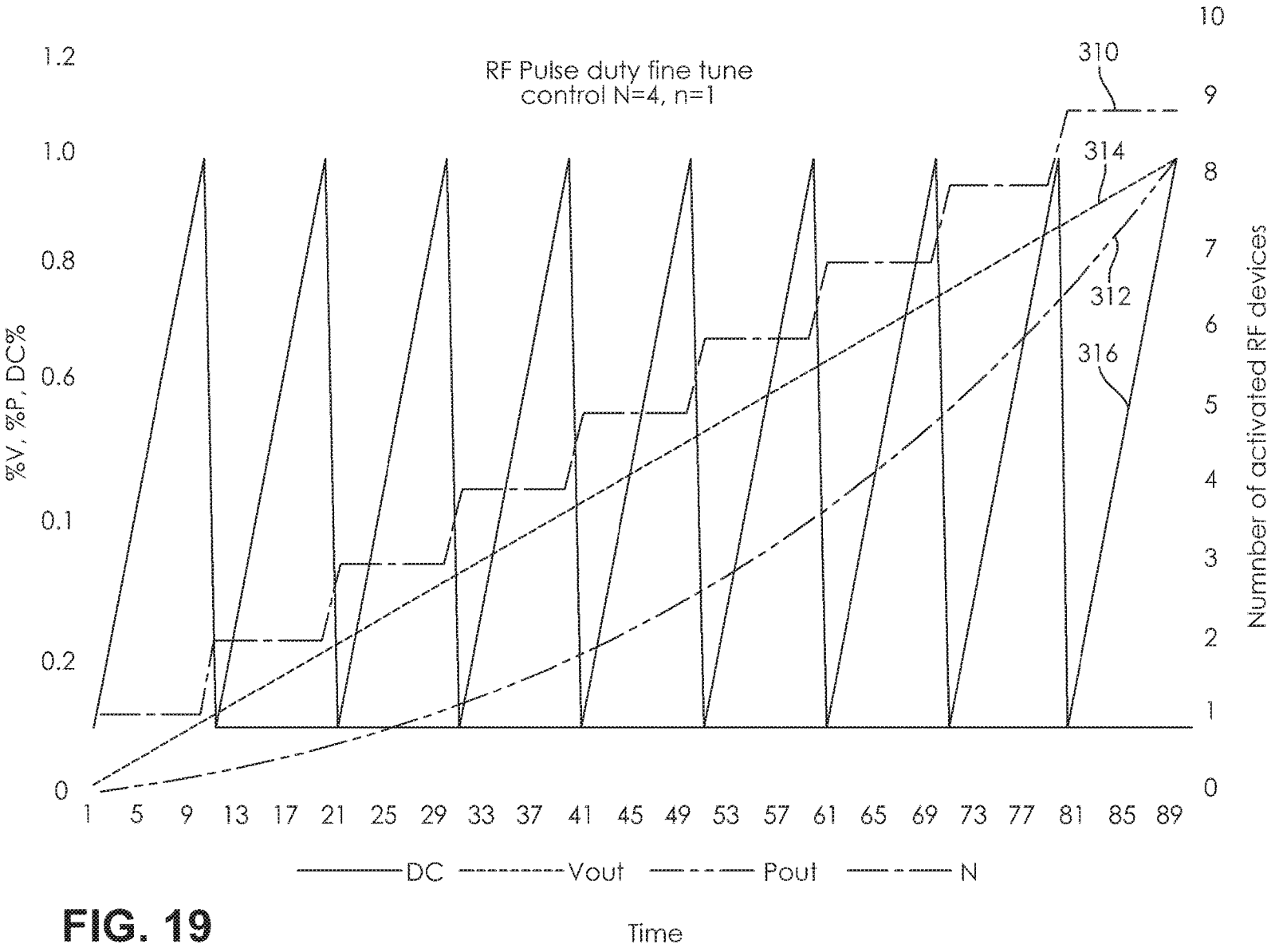
FIG. 19 is a graph of the quantity of activated RF devices, output power, output voltage, and duty cycle as a function of time.

FIG. 19 shows graphs of the quantity of activated RF devices 310, output power Pout 312, output voltage Vs 314, and duty cycle 316 as a function of time. This embodiment includes four (4) full RF devices, one (1) trim RF device, and an effective RF device number Neff equal to nine (9).

Any and all control methods disclosed herein may be combined together and implemented using the RF heating system. For different applications and power sizes, different configurations of RF devices and fine-tune power control methods may be used.

One or more embodiments, or elements thereof, can be implemented in the form of an apparatus including a storage device or memory, and at least one processing device or processor that is coupled to the memory and operative to perform a method according to one or more embodiments.

Figure 20:
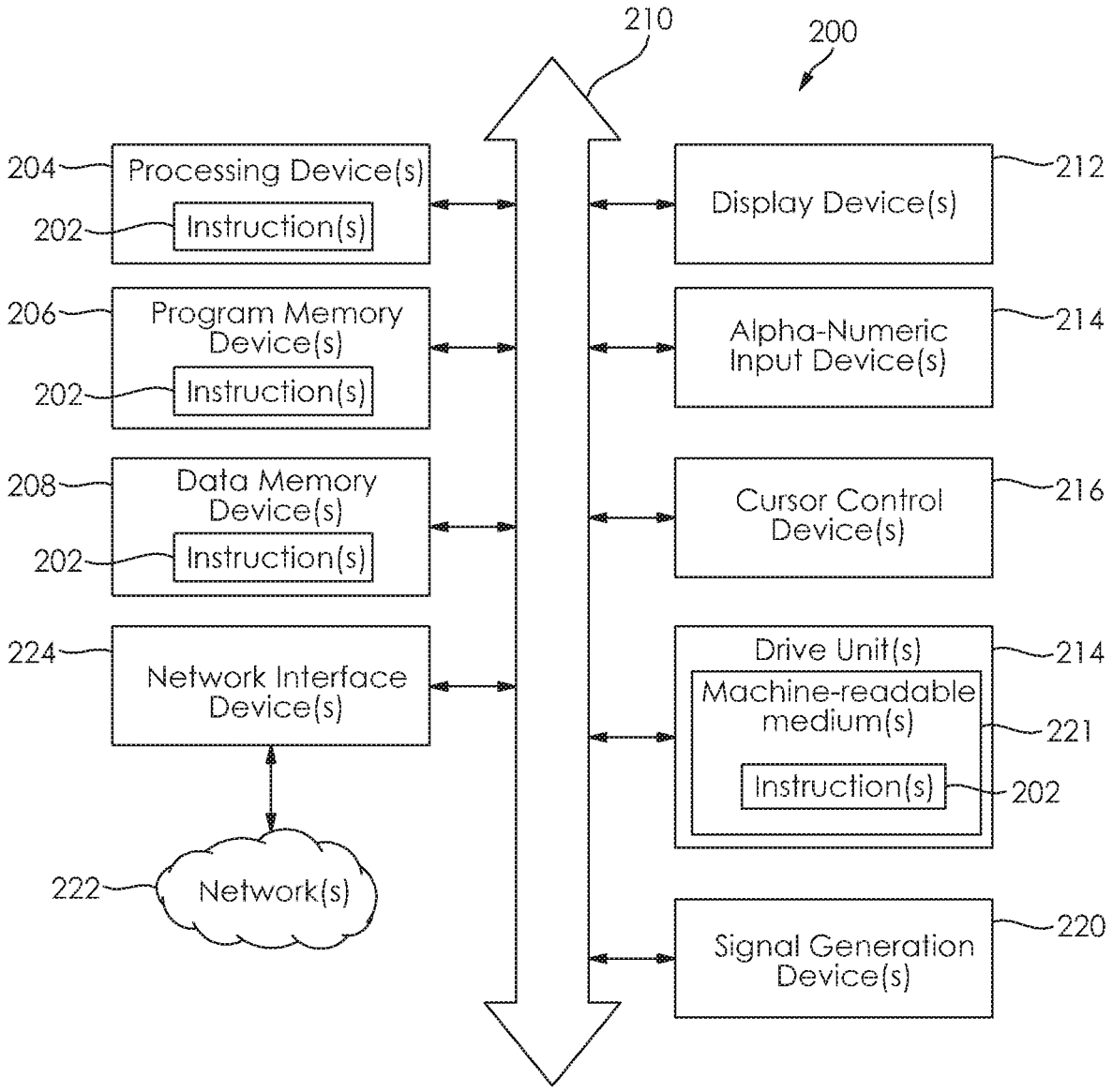
FIG. 20 is a block diagram of at least a portion of an exemplary machine in the form of a computing system that performs methods according to one or more embodiments disclosed herein.

One or more embodiments disclosed herein, or a portion thereof, make use of software running on a computer or workstation. By way of example, only and without limitation, FIG. 20 is a block diagram of an embodiment of a machine in the form of a computing system 200, within which is a set of instructions 202 that, when executed, cause the machine to perform any one or more of the methodologies according to embodiments disclosed herein. In one or more embodiments, the machine operates as a standalone device; in one or more other embodiments, the machine is connected (e.g., via a network 222) to other machines. In a networked implementation, the machine operates in the capacity of a server or a client user machine in a server-client user network environment. Exemplary implementations of the machine as contemplated by embodiments disclosed herein include, but are not limited to, a server computer, client user computer, personal computer (PC), tablet PC, personal digital assistant (PDA), cellular telephone, mobile device, palmtop computer, laptop computer, desktop computer, communication device, personal trusted device, web appliance, network router, switch or bridge, or any machine capable of executing a set of instructions (sequential or otherwise) that specify actions to be taken by that machine.

The computing system 200 includes a processing device(s) 204 (e.g., a central processing unit (CPU), a graphics processing unit (GPU), or both), program memory device(s) 206, and data memory device(s) 208, which communicate with each other via a bus 210. The computing system 200 further includes display device(s) 212 (e.g., liquid crystal display (LCD), flat panel, solid state display, or cathode ray tube (CRT)). The computing system 200 includes input device(s) 214 (e.g., a keyboard), cursor control device(s) 216 (e.g., a mouse), disk drive unit(s) 218, signal generation device(s) 220 (e.g., a speaker or remote control), and network interface device(s) 224, operatively coupled together, and/or with other functional blocks, via bus 210.

The disk drive unit(s) 218 includes machine-readable medium(s) 226, on which is stored one or more sets of instructions 202 (e.g., software) embodying any one or more of the methodologies or functions herein, including those methods illustrated herein. The instructions 202 may also reside, completely or at least partially, within the program memory device(s) 206, the data memory device(s) 208, and/or the processing device(s) 204 during execution thereof by the computing system 200. The program memory device(s) 206 and the processing device(s) 204 also constitute machine-readable media. Dedicated hardware implementations, such as but not limited to ASICs, programmable logic arrays, and other hardware devices can likewise be constructed to implement methods described herein. Applications that include the apparatus and systems of various embodiments broadly comprise a variety of electronic and computer systems. Some embodiments implement functions in two or more specific interconnected hardware modules or devices with related control and data signals communicated between and through the modules, or as portions of an ASIC. Thus, the example system is applicable to software, firmware, and/or hardware implementations.

The term "processing device" as used herein is intended to include any processor, such as, for example, one that includes a CPU (central processing unit) and/or other forms of processing circuitry. Further, the term "processing device" may refer to more than one individual processor. The term "memory" is intended to include memory associated with a processor or CPU, such as, for example, RAM (random access memory), ROM (read only memory), a fixed memory device (for example, hard drive), a removable memory device (for example, diskette), a flash memory and the like. In addition, the display device(s) 212, input device(s) 214, cursor control device(s) 216, signal generation device(s) 220, etc., can be collectively referred to as an "input/output interface," and is intended to include one or more mechanisms for inputting data to the processing device(s) 204, and one or more mechanisms for providing results associated with the processing device(s). Input/output or I/O devices (including but not limited to keyboards (e.g., alpha-numeric input device(s) 214, display device(s) 212, and the like) can be coupled to the system either directly (such as via bus 210) or through intervening input/output controllers (omitted for clarity).

In an integrated circuit implementation of one or more embodiments, multiple identical die are typically fabricated in a repeated pattern on a surface of a semiconductor wafer. Each such die may include a device described herein, and may include other structures and/or circuits. The individual dies are cut or diced from the wafer, then packaged as integrated circuits. One skilled in the art would know how to dice wafers and package die to produce integrated circuits. Any of the exemplary circuits or method illustrated in the accompanying figures, or portions thereof, may be part of an integrated circuit. Integrated circuits so manufactured are considered part of the disclosed embodiments.

An integrated circuit in accordance with the disclosed embodiments can be employed in essentially any application and/or electronic system in which buffers are utilized. Suitable systems for implementing one or more embodiments include, but are not limited, to personal computers, interface devices (e.g., interface networks, high-speed memory interfaces (e.g., DDR3, DDR4), etc.), data storage systems (e.g., RAID system), data servers, etc. Systems incorporating such integrated circuits are considered part of the disclosed embodiments. Given the teachings provided herein, one of ordinary skill in the art will be able to contemplate other implementations and applications.

In accordance with various embodiments, the methods, functions or logic described herein is implemented as one or more software programs running on a computer processor. Dedicated hardware implementations including, but not limited to, application specific integrated circuits, programmable logic arrays and other hardware devices can likewise be constructed to implement the methods described herein. Further, alternative software implementations including, but not limited to, distributed processing or component/object distributed processing, parallel processing, or virtual machine processing can also be constructed to implement the methods, functions or logic described herein.

The embodiment contemplates a machine-readable medium or computer-readable medium containing instructions 202, or that which receives and executes instructions 202 from a propagated signal so that a device connected to a network environment 222 can send or receive voice, video or data, and to communicate over the network 222 using the instructions 202. The instructions 202 are further transmitted or received over the network 222 via the network interface device(s) 224. The machine-readable medium also contains a data structure for storing data useful in providing a functional relationship between the data and a machine or computer in an illustrative embodiment of the systems and methods herein.

While the machine-readable medium 202 is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding, or carrying a set of instructions for execution by the machine and that cause the machine to perform any one or more of the methodologies of the embodiment. The term "machine-readable medium" shall accordingly be taken to include, but not be limited to: solid-state memory (e.g., solid-state drive (SSD), flash memory, etc.); read-only memory (ROM), or other non-volatile memory; random access memory (RAM), or other re-writable (volatile) memory; magneto-optical or optical medium, such as a disk or tape; and/or a digital file attachment to e-mail or other self-contained information archive or set of archives is considered a distribution medium equivalent to a tangible storage medium. Accordingly, the embodiment is considered to include any one or more of a tangible machine-readable medium or a tangible distribution medium, as listed herein and including art-recognized equivalents and successor media, in which the software implementations herein are stored.

It should also be noted that software, which implements the methods, functions and/or logic herein, are optionally stored on a tangible storage medium, such as: a magnetic medium, such as a disk or tape; a magneto-optical or optical medium, such as a disk; or a solid state medium, such as a memory automobile or other package that houses one or more read-only (non-volatile) memories, random access memories, or other re-writable (volatile) memories. A digital file attachment to e-mail or other self-contained information archive or set of archives is considered a distribution medium equivalent to a tangible storage medium. Accordingly, the disclosure is considered to include a tangible storage medium or distribution medium as listed herein and other equivalents and successor media, in which the software implementations herein are stored.

Although the specification describes components and functions implemented in the embodiments with reference to particular standards and protocols, the embodiment are not limited to such standards and protocols.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments are utilized and derived therefrom, such that structural and logical substitutions and changes are made without departing from the scope of this disclosure. Figures are also merely representational and are not drawn to scale. Certain proportions thereof are exaggerated, while others are decreased. Accordingly, the specification and drawings are to be regarded in an illustrative rather than a restrictive sense.

Such embodiments are referred to herein, individually and/or collectively, by the term "embodiment" merely for convenience and without intending to voluntarily limit the scope of this application to any single embodiment or inventive concept if more than one is in fact shown. Thus, although specific embodiments have been illustrated and described herein, it should be appreciated that any arrangement calculated to achieve the same purpose are substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single embodiment. Thus the following claims are hereby incorporated into the detailed description, with each claim standing on its own as a separate example embodiment.

The abstract is provided to comply with 37 C.F.R. § 1.72(b), which requires an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single embodiment. Thus the following claims are hereby incorporated into the Detailed Description, with each claim standing on its own as separately claimed subject matter.

Although specific example embodiments have been described, it will be evident that various modifications and changes are made to these embodiments without departing from the broader scope of the inventive subject matter described herein. Accordingly, the specification and drawings are to be regarded in an illustrative rather than a restrictive sense. The accompanying drawings that form a part hereof, show by way of illustration, and without limitation, specific embodiments in which the subject matter are practiced. The embodiments illustrated are described in sufficient detail to enable those skilled in the art to practice the teachings herein. Other embodiments are utilized and derived therefrom, such that structural and logical substitutions and changes are made without departing from the scope of this disclosure. This Detailed Description, therefore, is not to be taken in a limiting sense, and the scope of various embodiments is defined only by the appended claims, along with the full range of equivalents to which such claims are entitled.

Given the teachings provided herein, one of ordinary skill in the art will be able to contemplate other implementations and applications of the techniques of the disclosed embodiments. Although illustrative embodiments have been described herein with reference to the accompanying drawings, it is to be understood that these embodiments are not limited to the disclosed embodiments, and that various other changes and modifications are made therein by one skilled in the art without departing from the scope of the appended claims.

What is claimed is:

1. A radio frequency inductive heating apparatus associated with providing a finer resolution of power control, which comprises:

a control device configured to emit control signals;

a plurality of radio frequency devices, one or more of the plurality of radio frequency (RF) devices capable of being selectively activated using at least one of the control signals emitted by the control device, the plurality of RF devices comprising a first radio frequency device and a plurality of second radio frequency devices;

a plurality of transformers comprising a first transformer and a plurality of second transformers, each of the plurality of radio frequency devices being operatively coupled to a primary winding of one of the plurality of transformers, the first transformer comprising a differing turns ratio than the plurality of second transformers;

a resonant tank circuit, the plurality of transformers being operatively coupled to the resonant tank circuit, an operating frequency emitted by the control device being based on a resonant frequency of the resonant tank circuit;

a heating element, the heating element being operatively coupled to the resonant tank circuit;

a first power supply couplable to the first radio frequency device, the first power supply providing variable controlled voltage when coupled to the first radio frequency device; and a second power supply, operatively coupled to the plurality of the second radio frequency devices, the plurality of the second transformers operatively coupled to the plurality of the second radio frequency devices, the one or more of the plurality of the radio frequency devices capable of being selectively activated using direct-digital RF control thereof with an output voltage capable of being stepwise modified, the output voltage being based on a function of a quantity and/or identity of the plurality of the RF devices that are selectively activated, the direct-digital RF control capable of being combined with a phase-shift control based on the quantity of activated RF devices, thereby providing the finer resolution of power control using closed-loop direct-digital power control combined with fine-tune power control of the RF inductive heating apparatus.

2. The radio frequency inductive heating apparatus, as defined by claim 1, wherein the plurality of radio frequency devices receives a radio frequency signal from the control device, the radio frequency signal providing an operating frequency associated with the plurality of radio frequency devices, the operating frequency being based on a resonant frequency associated with the resonant tank circuit.

3. The radio frequency inductive heating apparatus, as defined by claim 1, wherein the first power supply is a variable power supply, an output voltage associated with the second power supply being greater than an output voltage associated with the first power supply.

4. The radio frequency inductive heating apparatus, as defined by claim 1, wherein at least one of the plurality of radio frequency devices is selectively activated by the control device based on a power set signal and a feedback signal, the power set signal representing a desired voltage associated with the resonant tank circuit, the feedback signal representing an electrical parameter associated with the resonant tank circuit.

5. The radio frequency inductive heating apparatus, as defined by claim 1, wherein at least one of the plurality of radio frequency devices comprises a full bridge inverter, the full bridge inverter receiving a first phase signal and a second phase signal, a phase difference between the first phase signal and the second phase signal being selectively adjusted to modify an output voltage associated with the at least one of the plurality of radio frequency devices.

6. The radio frequency inductive heating apparatus, as defined by claim 1, wherein the plurality of transformers comprises a first transformer and a second transformer, the first transformer comprising a first turns ratio, the second transformer comprising a second turns ratio, the first turns ratio being unequal to the second turns ratio.

7. The radio frequency inductive heating apparatus, as defined by claim 1, wherein each of the plurality of second transformers comprises a turns ratio equal to one of n:1 and (n−1):1, n representing a quantity of second radio frequency devices.

8. The radio frequency inductive heating apparatus, as defined by claim 1, wherein each of the plurality of second transformers comprises a turns ratio equal to $2^n$:1, n representing an increasing positive integer.

9. The radio frequency inductive heating apparatus, as defined by claim 1, wherein the first radio frequency device further comprises a first other radio frequency device and a second other radio frequency device, the first other radio frequency device being operatively coupled to the first power supply, the second other radio frequency device being operatively coupled to the second power supply.

10. The radio frequency inductive heating apparatus, as defined by claim 9, wherein the first power supply is a variable power supply, an output voltage associated with the second power supply being greater than an output voltage associated with the first power supply.

11. The radio frequency inductive heating apparatus, as defined by claim 9, wherein an output voltage associated with the second power supply is twice an output voltage associated with the first power supply.

12. The radio frequency inductive heating apparatus, as defined by claim 9, wherein at least one of the first power supply and the second power supply comprises a rectifier.

13. A method of providing radio frequency inductive heating associated with providing a finer resolution of power control, the method comprising:

activating a plurality of radio frequency (RF) devices selectively by a control device that is configured to emit control signals to the plurality of RF devices, the plurality of RF devices comprising a first radio frequency device and a plurality of second radio frequency devices;

coupling each of the plurality of radio frequency devices operatively to a primary winding of one of a plurality of transformers, each of the plurality of transformers comprising a first transformer and a plurality of second transformers, the first transformer comprising a different turns ratio than the plurality of second transformers;

coupling each of the plurality of transformers operatively to a resonant tank circuit;

coupling a heating element operatively to the resonant tank circuit, an operating frequency emitted by the control device being based on a resonant frequency of the resonant tank circuit;

configuring the first radio frequency device to be operatively couplable to a first power supply, the first power supply capable of providing variable controlled DC voltage when coupled to the first radio frequency device; and coupling the plurality of the second radio frequency devices operatively to a second power supply, whereby one or more of the plurality of the radio frequency devices are capable of being selectively activated using direct-digital RF control thereof with an output voltage being stepwise modified, the output voltage being based on a function of a quantity and/or identity of the plurality of the RF devices that are selectively activated, the direct-digital RF control capable of being combined with a phase-shift control based on the quantity of activated RF devices, thereby providing finer resolution of power control using closed-loop direct-digital power control with fine-tune power control of the inductive heating apparatus.

14. The method of providing radio frequency inductive heating, as defined by claim 13, further comprising receiving a radio frequency signal from the control device by the plurality of radio frequency devices, the radio frequency signal providing an operating frequency associated with the plurality of radio frequency devices, the operating frequency being based on a resonant frequency associated with the resonant tank circuit.

15. The method of providing radio frequency inductive heating, as defined by claim 13, wherein the first power supply is a variable power supply, an output voltage associated with the second power supply being greater than an output voltage associated with the first power supply.

16. The method of providing radio frequency inductive heating, as defined by claim 13, further comprising activating the at least one of the plurality of radio frequency devices selectively by the control device based on a power set signal and a feedback signal, the power set signal representing a desired voltage associated with the resonant tank circuit, the feedback signal representing an electrical parameter associated with the resonant tank circuit.

17. The method of providing radio frequency inductive heating, as defined by claim 13, wherein at least one of the plurality of radio frequency devices comprises a full bridge inverter, the method further comprising:

receiving, by the full bridge inverter, a first phase signal and a second phase signal; and modifying a phase difference between the first phase signal and the second phase signal selectively to modify an output voltage associated with the at least one of the plurality of radio frequency devices.

18. The method of providing radio frequency inductive heating, as defined by claim 13, wherein the plurality of transformers comprises a first transformer and a second transformer, the first transformer comprising a first turns ratio, the second transformer comprising a second turns ratio, the first turns ratio being unequal to the second turns ratio.

19. The method of providing radio frequency inductive heating, as defined by claim 13, wherein each of the plurality of second transformers comprises a turns ratio equal to one of n:1 and (n−1):1, n representing a quantity of second radio frequency devices.

20. The method of providing radio frequency inductive heating, as defined by claim 13, wherein each of the plurality of second transformers comprises a turns ratio equal to $2^n$:1, n representing an increasing positive integer.

21. The method of providing radio frequency inductive heating, as defined by claim 13, wherein the plurality of second radio frequency devices comprises a first other radio frequency device and a second other radio frequency device, the method further comprising:

coupling the first other radio frequency device operatively to the first power supply; and coupling the second other radio frequency device operatively to the second power supply.

22. The method of providing radio frequency inductive heating, as defined by claim 21, wherein the first power supply is a variable power supply, an output voltage associated with the second power supply being greater than an output voltage associated with the first power supply.

23. The method of providing radio frequency inductive heating, as defined by claim 21, wherein an output voltage associated with the second power supply is twice an output voltage associated with the first power supply.

24. The method of providing radio frequency inductive heating, as defined by claim 21, wherein at least one of the first power supply and the second power supply comprises a rectifier.

* * * * *